US008731705B2

(12) United States Patent
Maki

(10) Patent No.: US 8,731,705 B2
(45) Date of Patent: May 20, 2014

(54) DATA GENERATOR, COMPUTER READABLE RECORDING MEDIUM, AND SEWING MACHINE

(75) Inventor: Ryutaro Maki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 40 days.

(21) Appl. No.: 13/569,759

(22) Filed: Aug. 8, 2012

(65) Prior Publication Data

US 2013/0041496 A1 Feb. 14, 2013

(30) Foreign Application Priority Data

Aug. 10, 2011 (JP) ..... 2011-174907

(51) Int. Cl.
*D05C 5/02* (2006.01)

(52) U.S. Cl.
USPC ..... 700/138; 112/470.01

(58) Field of Classification Search
USPC ..... 700/136–138; 112/470.01, 470.04, 112/470.06, 475.18, 475.19
See application file for complete search history.

(56) References Cited

U.S. PATENT DOCUMENTS

| | | | | |
|---|---|---|---|---|
| 4,869,188 | A * | 9/1989 | Hyodo | 112/470.04 |
| 5,740,057 | A * | 4/1998 | Futamura | 700/138 |
| 5,751,583 | A | 5/1998 | Kyuno et al. | |
| 5,954,004 | A | 9/1999 | Futamura | |
| 6,012,402 | A * | 1/2000 | Sekine | 112/470.04 |
| 6,304,793 | B1 | 10/2001 | Komiya et al. | |
| 6,321,670 | B1 | 11/2001 | Tomita | |
| 6,324,441 | B1 | 11/2001 | Yamada | |
| RE38,718 | E * | 3/2005 | Futamura | 700/138 |
| 6,980,877 | B1 * | 12/2005 | Hagino et al. | 700/138 |
| 7,503,271 | B2 | 3/2009 | Hayakawa | |
| 7,542,822 | B2 * | 6/2009 | Kawaguchi et al. | 700/138 |
| 2007/0199492 | A1 | 8/2007 | Ishii | |

FOREIGN PATENT DOCUMENTS

| | | |
|---|---|---|
| JP | A-11-057262 | 3/1999 |
| JP | B2-2874674 | 3/1999 |

OTHER PUBLICATIONS

"Overview of Electric Quilt 6 Software," http://www.electricquilt.com/Shop/EQ6/EQ6.asp, Retrieved on Oct. 18, 2010, 6 pages, The Electric Quilt Company.
"User's Guide to Electric Quilt 6 Software," http://www.rasenkaidan.com, Retrieved on Oct. 18, 2010, 13 pages, Rasenkaidan.

(Continued)

*Primary Examiner* — Nathan Durham
(74) *Attorney, Agent, or Firm* — Oliff PLC

(57) ABSTRACT

A data generator includes a memory and a processor. The memory may store a plurality of predetermined colors. The processor may control the data generator to assign a color, to display an embroidery pattern, to designate a color of the thread color data, and to allocate the designated color. The color, which is extracted randomly from the plurality of predetermined colors, may be assigned as a thread color data of each of a plurality of color-based pattern portions. The embroidery pattern may be displayed to a screen with the color assigned to each of the plurality of color-based pattern portions. The color of the thread color data designated from each of the plurality of color-based pattern portions may be included in the displayed embroidery pattern. The designated color may be allocated with priority over the plurality of predetermined colors for each of the plurality of color-based pattern portions.

12 Claims, 17 Drawing Sheets

(56) References Cited

OTHER PUBLICATIONS

"User's Guide to Adobe Illustrator CS4," http://help.adobe.com/en_US/Illustrator/14.0/WS8F5038A7-E2BE-402f-B15F-850702A681C2a.html, Retrieved on Apr. 2, 2012, 8 pages (with translation).

U.S. Appl. No. 13/361,401, filed Jan. 30, 2012.

U.S. Appl. No. 13/561,573, filed Jul. 30, 2012 in the name of Yuki Ihira.

Dec. 20, 2013 Office Action issued in U.S. Appl. No. 13/361,401.

Jan. 17, 2014 Office Action issued in U.S. Appl. No. 13/561,573.

* cited by examiner

| EMBROIDERY DATA | |
|---|---|
| FIRST PATTERN PORTION DATA | PATTERN 1 RED |
| | Xa0,Ya0 |
| | Xa1,Ya1 |
| | Xa2,Ya2 |
| | ⋮ |
| | XaN,YaN |
| SECOND PATTERN PORTION DATA | PATTERN 2 LIME GREEN |
| | Xb0,Yb0 |
| | Xb1,Yb1 |
| | Xb2,Yb2 |
| | ⋮ |
| | XbN,YbN |
| THIRD PATTERN PORTION DATA | PATTERN 3 GREEN |
| | Xc0,Yc0 |
| | Xc1,Yc1 |
| | Xc2,Yc2 |
| | ⋮ |
| | XcN,YcN |
| ⋮ | ⋮ |
| nTH PATTERN PORTION DATA | PATTERN n YELLOW |
| | Xn0,Yn0 |
| | Xn1,Yn1 |
| | Xn2,Yn2 |
| | ⋮ |
| | XnN,YnN |

FIG. 4

DATA GENERATOR, COMPUTER READABLE RECORDING MEDIUM, AND SEWING MACHINE

CROSS-REFERENCE TO RELATED APPLICATION

This application is based upon and claims the benefit of priority from the prior Japanese Patent Application 2011-174907, filed on, Aug. 10, 2011, the entire contents of which are incorporated herein by reference.

FIELD

The disclosure relates to a data generator that may generate embroidery data of an embroidery pattern including a plurality of color-based pattern portions, a computer readable recording medium storing a program which generates data for embroidery, and a sewing machine that may sew the embroidery pattern based on the embroidery data.

BACKGROUND

Conventionally, sewing machines, which sew the embroidery pattern based on the embroidery data, have been known. For the sewing machines, the embroidery data may be stored in storage devise in the sewing machines or external storage devise such as ROM (Read Only Memory) cards or flexible disks. Users may select a desirable embroidery pattern from a plurality of embroidery patterns. The sewing machines load the selected embroidery data to stitch the embroidery pattern to a fabric.

The embroidery pattern includes a plurality of pattern-by-color portions. The embroidery data of the embroidery pattern includes thread color data which identify a color of the pattern-by-color portion. Each of the plurality of pattern-by-color portions is sewn by the thread color which is predetermined as the thread color data. If a color of each of the plurality of pattern-by-color portions is analogous to a color of the fabric, it would be difficult to distinguish the pattern-by-color portion from the fabric. Specifically, in the case that an embroidery pattern of a flower is sewn into a fabric with the same color as that of the pattern-by-color portion of a petal of the flower, it would be difficult to distinguish the petal from the fabric. Thus, the embroidery pattern would be strange because of the lack of the petal.

Some data generators may store coloring data which represent combinations of preferable colors. The data generators may set a color of the thread color data of the pattern-by-color portion based on the coloring data and the fabric data which represent a color of the fabric. The data generators may determine the pattern-by-color portion in the color of the embroidery pattern unambiguously based on the color of the fabric and the coloring data. Some user may prefer to sew each of the plurality of pattern-by-color portions with a preferable color or a strange color rather than with a predetermined color. However, setting a color of the embroidery pattern preferably would be troublesome because it is required to load data of the pattern-by-color portion and to confirm and designate corresponding thread color data.

SUMMARY

The disclosure may provide a data generator, a non-transitory computer readable recording medium storing computer readable instructions, and a sewing machine that may obtain an embroidery pattern which includes various color patterns based on colors preferred by a user.

A data generator includes a memory and a processor. The memory may store a plurality of predetermined colors. The processor may control the data generator to assign a color, to display an embroidery pattern, to designate a color of the thread color data, and to allocate the designated color. The color, which is extracted randomly from the plurality of predetermined colors, may be assigned as a thread color data of each of a plurality of color-based pattern portions. The embroidery pattern may be displayed to a screen with the color assigned to each of the plurality of color-based pattern portions. The color of the thread color data designated from each of the plurality of color-based pattern portions may be included in the displayed embroidery pattern. The designated color may be allocated with priority over the plurality of predetermined colors for each of the plurality of color-based pattern portions.

BRIEF DESCRIPTION OF THE DRAWINGS

FIG. 4 is a view showing an example of embroidery data;

DETAILED DESCRIPTION

One embodiment of the disclosure is exemplified through a household sewing machine hereinafter referred to as a sewing machine M and will be described in detail with reference to FIGS. 1 to 16.

Figure 1:
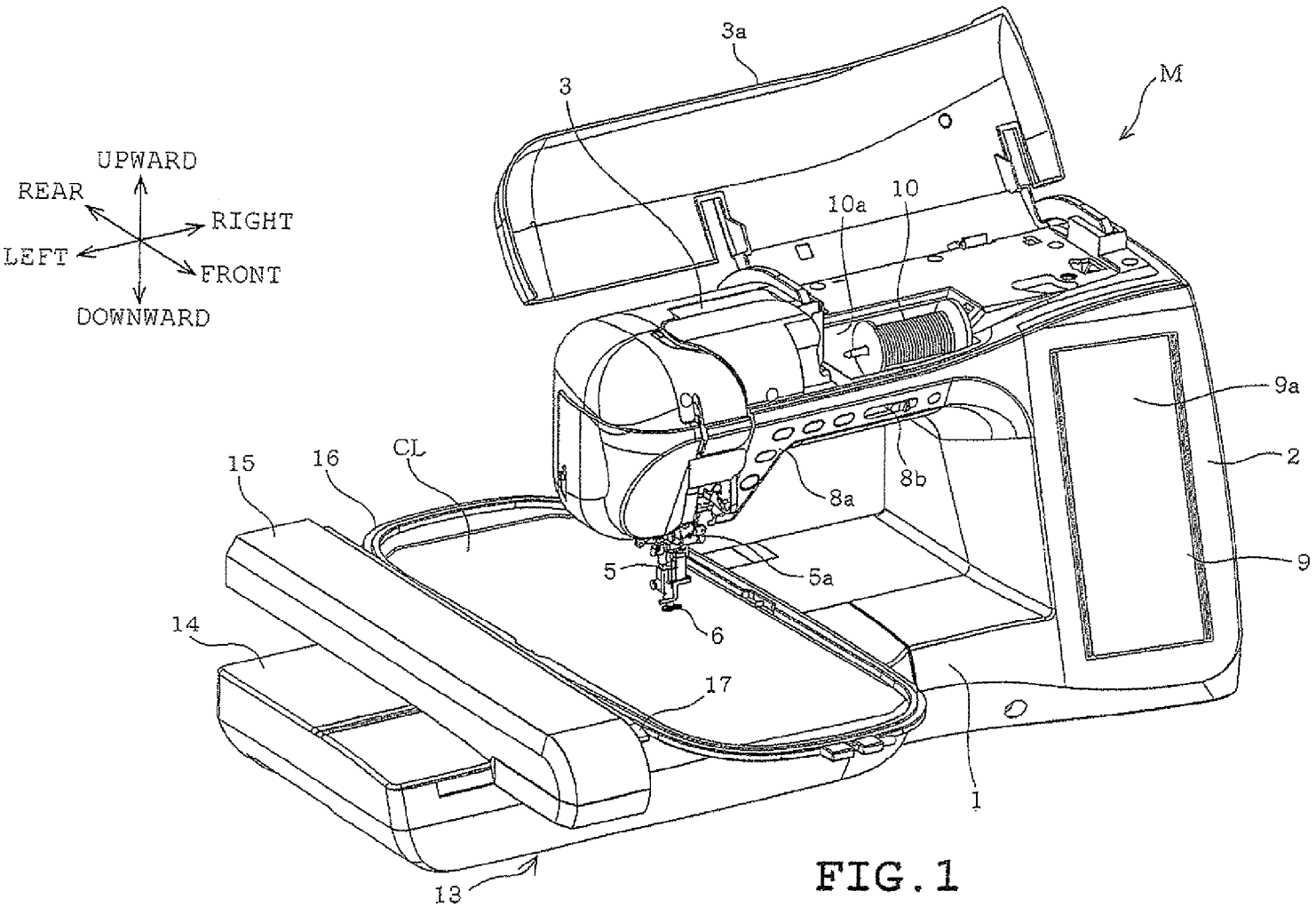
FIG. 1 is a perspective view of a sewing machine.

Referring to FIG. 1, the sewing machine M is primarily configured by a bed 1, a pillar 2, and an arm 3 that are structurally integral. The pillar 2 extends upward from the right end of the laterally oriented bed 1. The arm 3 extends leftward from the upper portion of the pillar 2 and contains a laterally extending main shaft not shown of the sewing machine and a sewing machine motor 4 shown in FIG. 4 that drives the main shaft in rotation. Description will be given hereinafter with an assumption that the direction in which the user/operator positions himself/herself to face the sewing machine M is the forward direction and the opposite side, naturally, is the rear direction. Further, the direction in which the pillar 2 is located relative to the center of the bed 1 is assumed as the rightward direction and the opposite side, is assumed as the left direction.

At one end of the arm 3 distal from the pillar 2, a needle bar 5*a* and a presser bar not shown are provided. The needle bar 5*a* has a sewing needle 5 attached to it whereas the presser bar has a presser foot 6 attached to it. Though not shown, the arm 3 further contains components such as a needle-bar drive mechanism, a needle-bar swing mechanism, a thread take-up drive mechanism, and a presser-bar drive mechanism. The needle-bar drive mechanism moves the needle bar 5*a* up and down through the rotation of the main shaft. The needle-bar swing mechanism swings the needle bar 5*a* in a direction orthogonal to the direction in which the fabric is fed. In the present embodiment, the needle bar 5*a* is swung in the left and right direction. The thread take-up drive mechanism drives the thread-take up and down in synchronism with the up and down movement of the needle bar 5*a*. The presser-bar drive mechanism drives the presser bar up and down.

At the upper portion of the arm 3, an openable/closable cover 3*a* is provided that, when opened, reveals a slot 10*a* defined on the forward mid portion of the arm 3 for storing a thread spool 10. Needle thread drawn from the thread spool 10 is engaged with a number of components such as the thread take-up that define a thread passageway to be ultimately supplied to the sewing needle 5.

On the front side of the arm 3, various operation switches such as a start/stop switch 8*a* for starting and stopping a sewing operation is provided as well as a speed adjustment dial 8*b* for setting the sewing speed, in other words, the speed of rotation of the main shaft.

Figure 2:
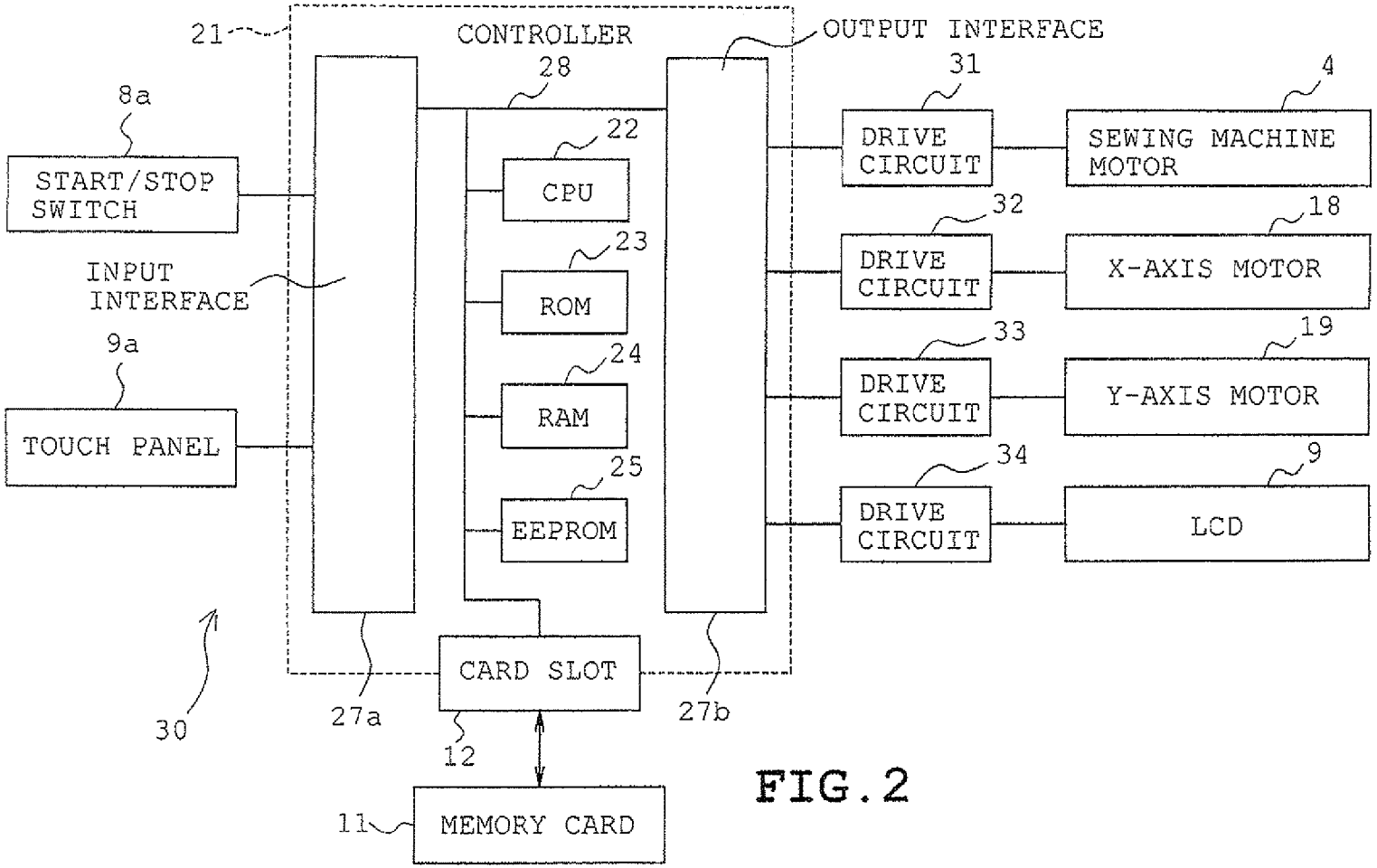
FIG. 2 is a block diagram showing an electrical arrangement of the sewing machine.

On the front face of the pillar 2, a sizable and vertically elongate liquid crystal display 9 capable of displaying in full color is provided, which is hereinafter simply referred to as an LCD 9. The LCD 9 displays various information such selection of patterns/stitches including embroidery patterns and utility stitches, names of various functionalities to be executed in a sewing operation, and user interfaces such as screens such as those shown in FIG. 5 for setting the colors to be applied to the embroidery patterns as will be later described. On the front face of the LCD 9, a touch panel 9*a* is provided as shown in FIG. 2 that has multiple touch keys comprising transparent electrodes and touch keys. The touch keys are depressed by the user's fingers or a touch pen not shown for selecting embroidery patterns to be sewn, giving instructions for executing the desired function, and setting various parameters, etc.

On the right side surface of the pillar 2, a card slot 12 is provided for insertion of a memory card 11 only shown in FIG. 2 that stores data such as embroidery data for various types of embroidery patterns.

On the upper surface of the bed 1, a needle plate not shown is provided. Within the bed 1 below the needle plate components such as a cloth feed mechanism, a horizontal shuttle mechanism, and a thread cutter are provided neither of which are shown. The cloth feed mechanism drives a feed dog up and down and backend forth. The horizontal shuttle mechanism contains a bobbin and forms stitches in cooperation with a sewing needle 5. The thread cutter mechanism cuts a needle thread and a bobbin thread.

The bed 1 allows detachable attachment of an embroidery frame transfer device 13 at its left end. The embroidery frame transfer device 13 is primarily configured by a body 14 and a movable section 15. The body 14 is substantially level with the upper surface of the bed 1 when the embroidery frame transfer device 13 is attached to the bed 1. The movable member 15 is provided on the upper surface of the body 14 so as to be movable in the left and right direction over the body 14. The embroidery frame transfer device 13 is further provided with a carriage 17, an X-direction transfer mechanism and a Y-direction transfer mechanism that are neither shown. The carriage 17 is attached to the movable member 15 so as to be movable in the front and rear direction relative to the movable member 15 and allows detachable attachment of an embroidery frame 16 which holds a fabric CL to be sewn. The X-direction transfer mechanism drives the carriage 17 as well as the movable member 15 in the left and right direction. The Y-direction transfer mechanism drives the carriage 17 in the front and rear direction. The X- and Y-direction transfer mechanisms are each provided with a dedicated motor later described, which are identified as an X-axis motor 18 and a Y-axis motor 19 shown in FIG. 2, to drive the carriage 17 holding the embroidery frame 16 in the X and Y directions respectively. In the present embodiment, the X direction indicates the left and right direction and the Y direction indicates the forward and rear direction.

Next, a description will be given on a control system of the sewing machine M with reference to the block diagram of FIG. 2.

A controller 21 is primarily configured by a microcomputer including a CPU 22, a ROM 23, a RAM 24, a card slot 12, an input interface 27*a*, an output interface 27*b*, and a bus 28 that interconnects the foregoing elements. The input interface 27*a* establishes connection with components such as a start/stop switch 8*a* and a touch panel 9*a*, whereas the output interface 27*b* establishes connection with components such as sewing machine motor 4, an X-axis motor 18, a Y-axis motor 19, the LCD 9 and drive circuits 31, 32, 33, and 34 that drive the foregoing components, respectively. The controller 21, the LCD 9, and the drive circuit 34 are examples of a display unit. Components such as the controller 21, the touch panel 9*a*, the LCD 9, and the drive circuit 34 constitute embroidery data generator 30.

The ROM 23 pre-stores items such as embroidery data, a sewing control program, a master thread information table, and a display control program that controls the LCD 9. The master thread information table contains all the information pertaining to types of threads used in embroidering such as the later described color information, and product ID. The ROM 23 further stores an embroidery data processing program which makes the computer function as a processing unit for generating embroidery data. The foregoing programs and data may be stored in an internal storage such as an EEPROM 25 or an external storage such as a memory card 11. In case the embroidery data processing program is stored in the external storage, the controller 21 executes the program by loading it into the RAM 24.

Figure 3:
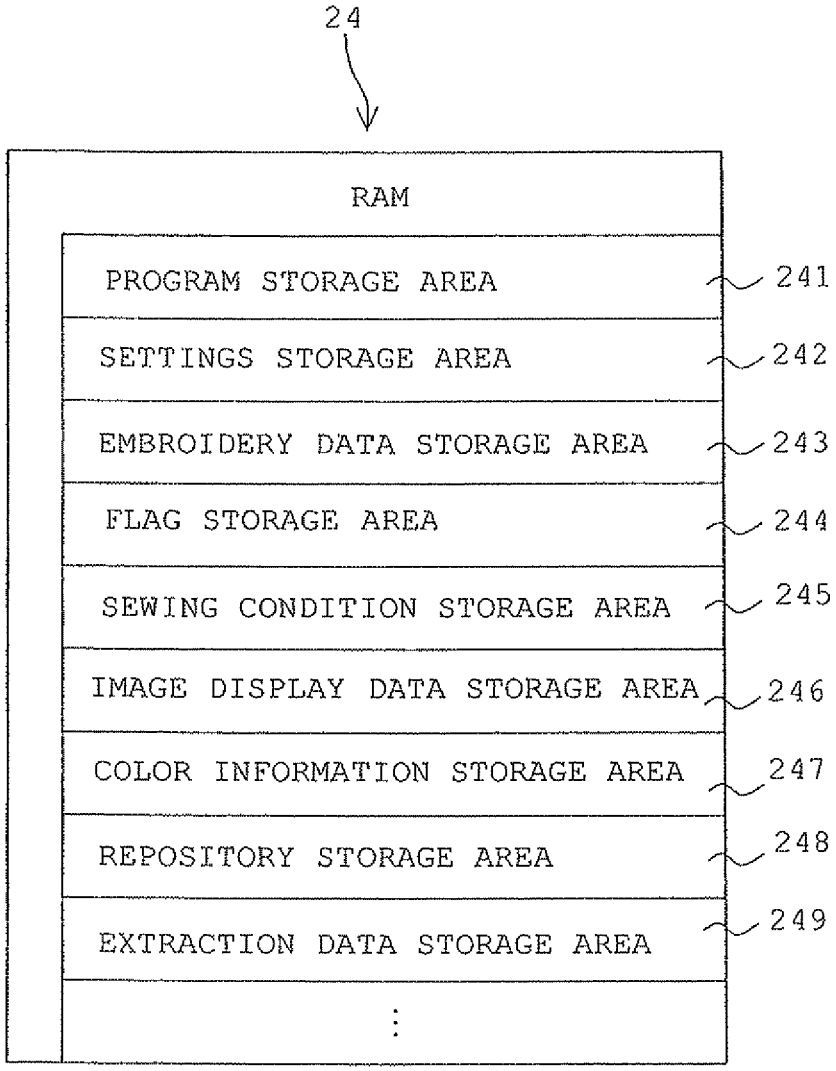
FIG. 3 is a schematic view showing storage areas of RAM of the sewing machine.

The RAM 24 is provided with a storage area for temporarily storing items such as the above described programs, data, various settings made through the touch panel 9*a*, and the result of calculation by the controller 21. FIG. 3 exemplifies the RAM 24 provided with storage areas such as a program storage area 241, a settings storage area 242, an embroidery data storage area 243, a flag storage area 244, a sewing condition storage area 245, image display data storage area 246, a color information storage area 247, a repository storage area 248, and an extraction data storage area 249.

The program storage area 241 stores various programs read from sources such as the ROM 23. The settings storage 242 stores settings and look-up tables being referred during program execution. The embroidery data storage area 243 stores the source data on which the embroidery data generation is based. The flag storage area 244 stores various flags used during program execution. The sewing condition storage area 245 stores various conditions applied when sewing a given embroidery pattern. The image display data storage area 246 stores image data and settings of the screens to be displayed on the LCD 9.

The color information storage area 247 is an area for storing data used in coloring the embroidery patterns and stores information such as the later described palette table containing palette-based color numbers. As later described in detail, the repository storage area 248 stores the colors designated by the user from the color-based pattern portions of the embroidery pattern. The extraction data storage area 249 is a primary storage area for storing colors randomly extracted from the palette table. The RAM 24 provided with the repository storage area 248 is one example of a second storage.

Next, an embroidery pattern in the context of the disclosure will be described through an example of an embroidery pattern 40 displayed on a screen 103 shown on LCD 9, which is an illustration of a flower. The embroidery pattern 40 comprises n number of color-based pattern portions identified as a first pattern portion 401 to nth pattern portion 40*n*. More specifically, the first pattern portion 901 that represent the petals of the flower are sewn in red, the second pattern portion 402 that represent the leaves are sewn in yellow, and the third pattern portion 403 that represent the stems are sewn in green. As described above, the pattern portions 401 to 40*n* are color-based pattern portions that are each assigned a color. The colors assigned to each of the pattern portions 401 to 40*n* need not be unique.

The embroidery data is used to sew embroidery patterns with the sewing machine M and comprises multiplicity of color-based pattern portion data for each embroidery pattern. Referring to FIG. 4, for instance, the embroidery data of the embroidery pattern 40 contains multiplicity of needle drop data specified for each of the pattern portions 401 to 40*n*, sewing sequence data specifying the sequence in which the pattern portions 401 to 40*n* are sewn as indicated as "PATTERN 1, . . . , PATTERN N", and thread color data. The thread color data is data appended to assign a color to each color-based pattern portion and the color is assigned from the collection of color information by a later described assigning unit.

Still referring to FIG. 4, "PATTERN 1" appearing in the top row of the first pattern portion indicates the sewing sequence data that identifies the first sewn pattern portion and "RED" is the color data indicating the color in which the pattern portion is to be sewn, which is specified by color models such as RGB values in implementation. The needle drop data "Xa0, Ya0" . . . "XaN, YaN" indicate the coordinates in which the sewing needle 5 carrying the red thread color is to be struck in the specified sequence. The pattern portion data sewn second in sequence and onwards similarly contain: the sewing sequence data which range, in this case, from "PATTERN 2" to "PATTERN n"; the thread color data ranging from "lime green" to "yellow"; and the needle drop data ranging from "XbN, YbN" to "XnN, YnN". The embroidery data also contains image data, such as bmp data not shown, that are to be displayed on the LCD 9, and the image of the embroidery pattern appears on the LCD 9 in the color assigned by the thread color data.

The EEPROM 25 stores color information from which a color is assigned to the embroidery data in the form of thread color data. The EEPROM 25 is one example of a first storage. The color information pertains, for example, to the colors of threads wound on thread spools 10 which are made available for use with the sewing machine M and is pre-defined in RGB values. In the present embodiment, some of the color information stored in the EEPROM 25 is implemented as a first palette table which contains information for producing a first color palette 56*a* shown in FIG. 6. The first palette table contains RGB values of 64 colors and palette-based color numbers 1 to 64 associated with each RGB value. Apart from the first palette table, the EEPROM 25 further implements some of the color information as a second palette table which stores information of colors pre-selected by the user from the color information. The second palette table contains information for producing a second color palette 56*b* shown in FIG. 7. The second palette table is a custom palette table which may be edited by the user to contain RGB values and their associated palette-based color numbers for a maximum of 300 colors.

The present embodiment further employs HSV color model which is a different representation of RGB values. HSV stands for Hue, Saturation, and Value and HSV value is calculated by the controller 21 based on RGB values by applying known calculation methods. Hue H indicates the type of color such as red, purple, and blue, and is represented by a numerical range of 0 to 360. Saturation S indicates the vividness of the color and is represented by a numerical range of 0.0 to 1.0. Value V indicates the brightness of the color and is represented by a numerical range of 0.0 to 1.0.

Figure 5:
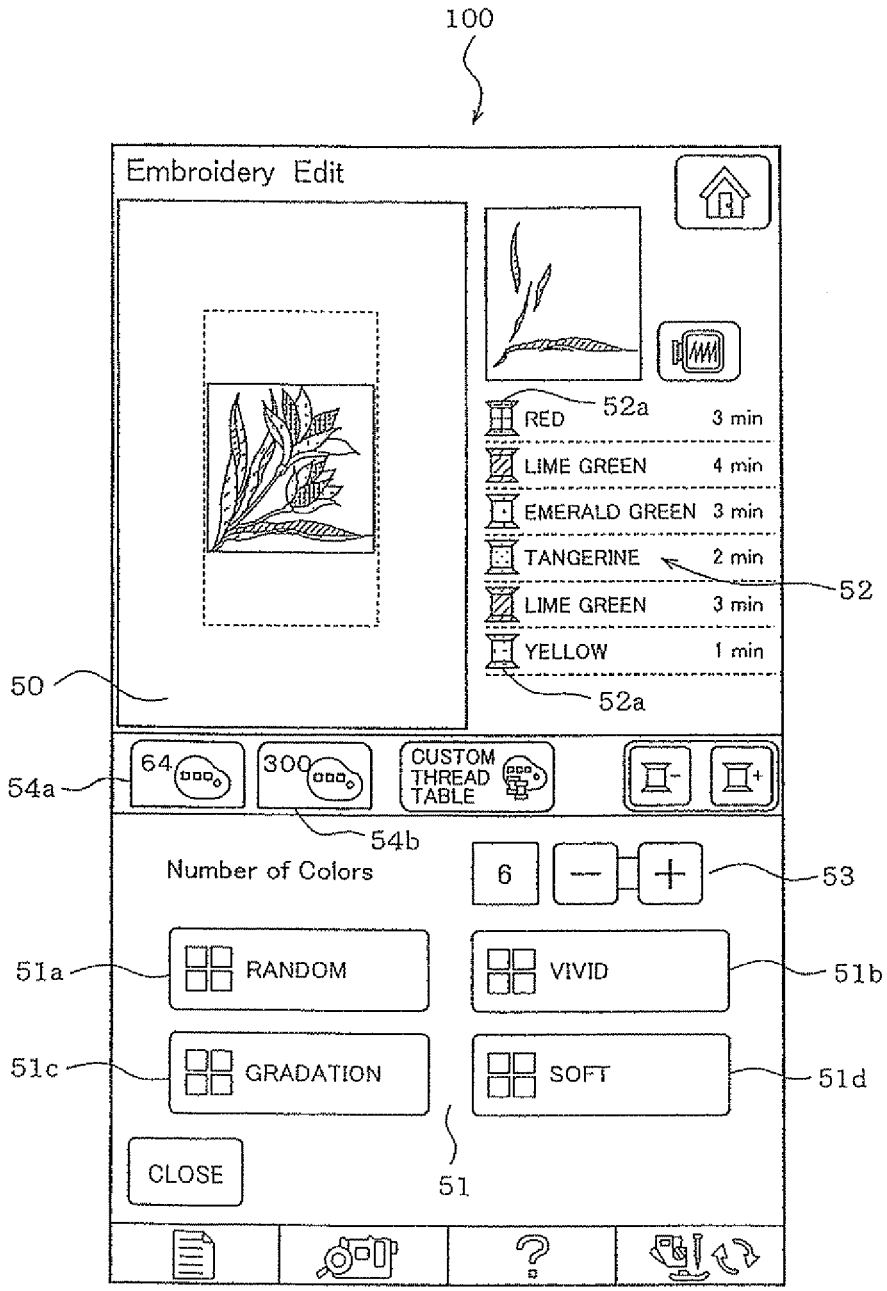
FIG. 5 is a view showing an example of a screen to select a coloring mode when the embroidery data is generated.

The color information may be categorized by type such as "Vivid", "Soft", and "Gradation" as shown in FIG. 5. Each category of the color information is distinguished by threshold values represented by HSV values.

Figure 15:
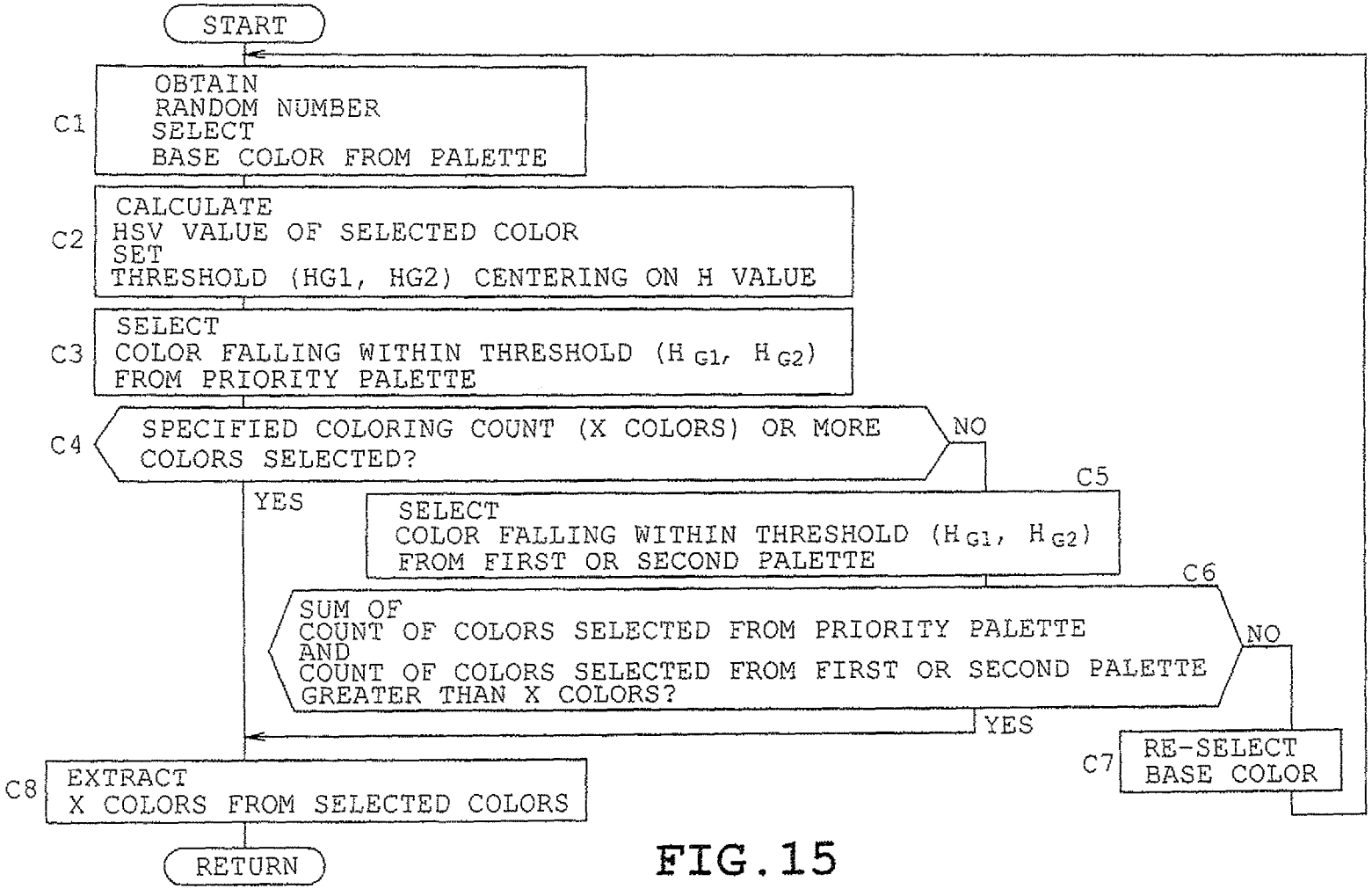
FIG. 15 is a flowchart showing an extraction process in a gradation coloring mode.
Figure 16:
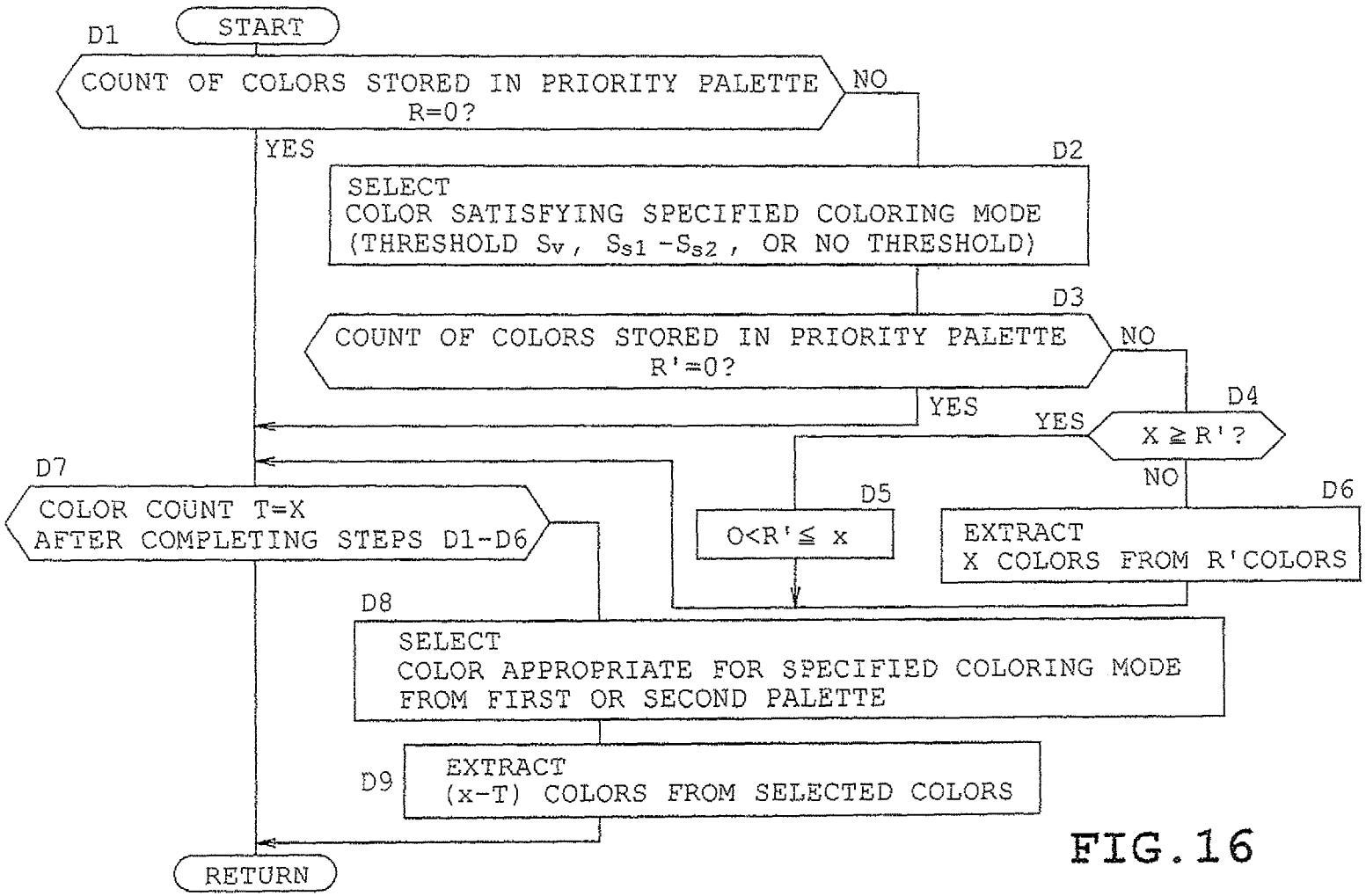
FIG. 16 is a flowchart showing a selection process in a random, vivid, and soft coloring modes.

For instance, the "Vivid" category is established by setting threshold $S_v$ for saturation S as indicated in step D2 of FIG. 16. The "Vivid" category contains the color information having saturation S greater than threshold $S_v$. The colors categorized as "Vivid" have a vivid tone and have a relatively high level of saturation. The "Soft" category is established by setting a range of saturation S defined by upper limit $S_{S1}$ and lower limit $S_{S2}$ as indicated in step D2. The colors categorized as "Soft" do not vary significantly in their level of saturation and generally give a soft impression. The "Gradation" category is established by setting a range of Hue H thresholds $H_{G1}$ to $H_{G2}$ centering on Hue H of a certain color as indicated in step C2 of FIG. 15. The colors categorized as "Gradation" thus, show a gradation of a given color such as purple ranging between threshold $H_{G1}$ which may correspond to red and threshold $H_2$ which may correspond to blue. Each of the above described thresholds $S_v$, $S_{S2}$, $H_{G1}$ and $H_{G2}$ are stored in the EEPROM 25.

By depressing, or also hereinafter touching, either of the touch keys 51*b* to 51*d* associated with the categories "vivid", "Soft", and "Gradation", a coloring mode is specified which extracts colors according to the selected category. In contrast, touching the key 51*a* associated with the "Random" category specifies a coloring mode in which colors are selected from multiplicity of colors spanning across different categories. As will be later described in detail, each of the coloring modes associated with keys 51*a* to 51*d* executes an assignment process that randomly extracts and assigns a color for each thread color data of the color-based pattern portion.

The controller 21 is configured to generate a random number in the aforementioned assignment process by executing a program function which takes the maximum palette-based color number as a parameter and generates a random number falling within the range of the palette-based color number. For example, a random number is generated that ranges from 1 to 64 based on the first palette table. The controller 21 searches the palette-based color number within the first palette table that matches the generated random number and extracts information such as the RGB value associated with the matching palette-based color number. Thus, a color is randomly selected from 64 cells of the first color palette 56*a*, each cell representing 1 of the 64 colors.

Figure 10:
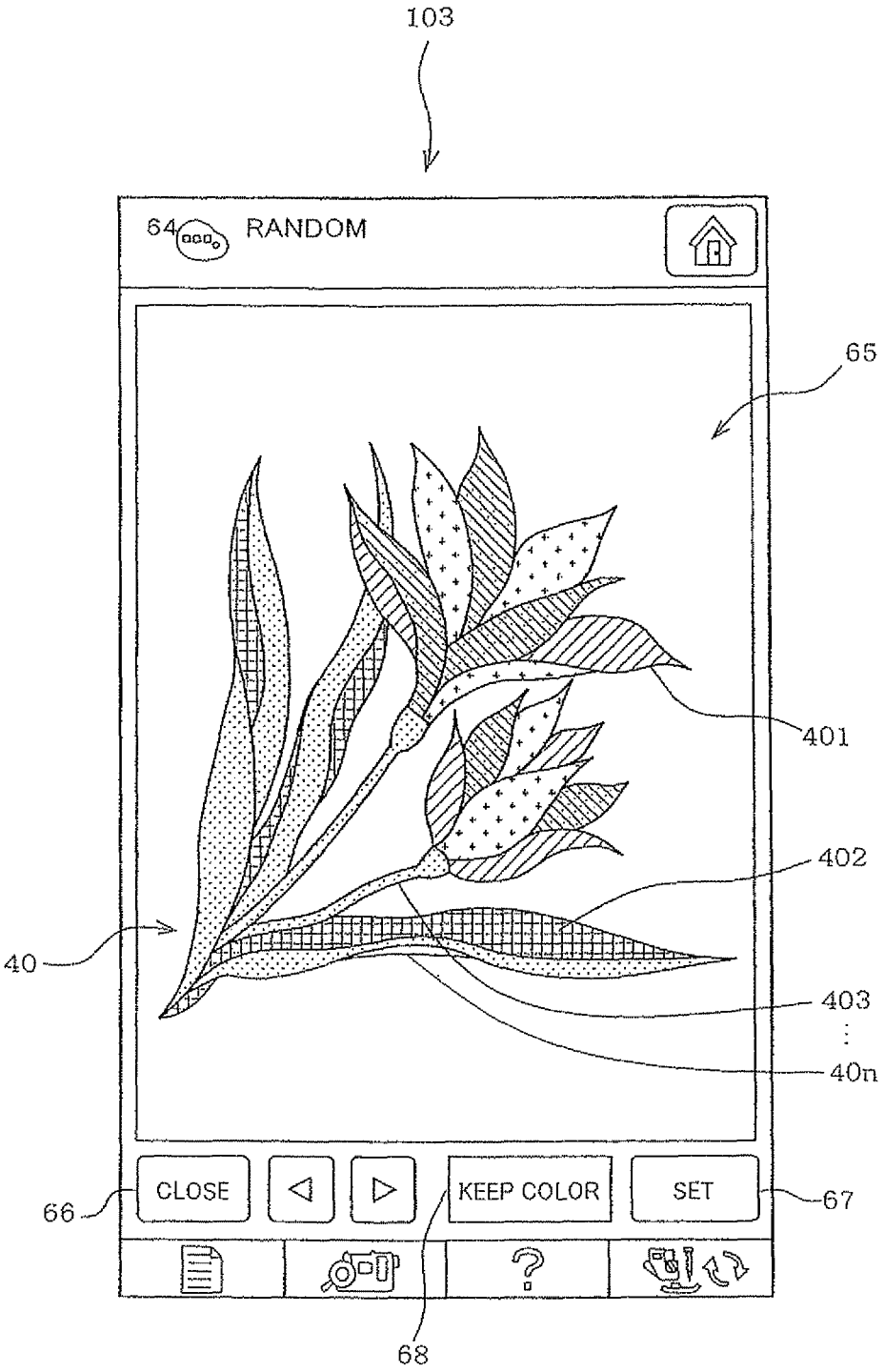
FIG. 10 is a view showing an example of an enlarge screen.
Figure 11:
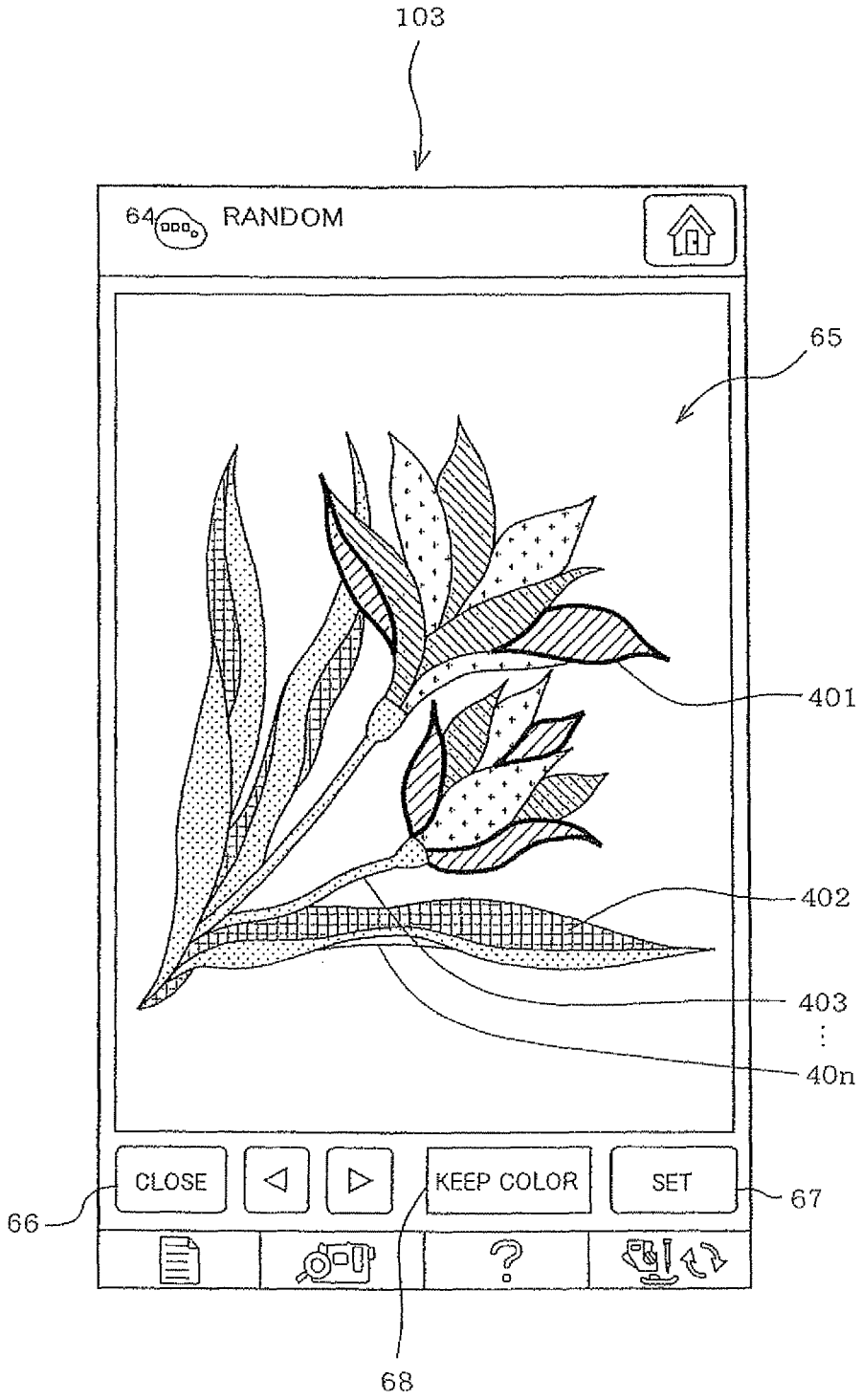
FIG. 11 is a view similar to FIG. 10 but the designated color-based pattern portion is emphasized.
Figure 12:
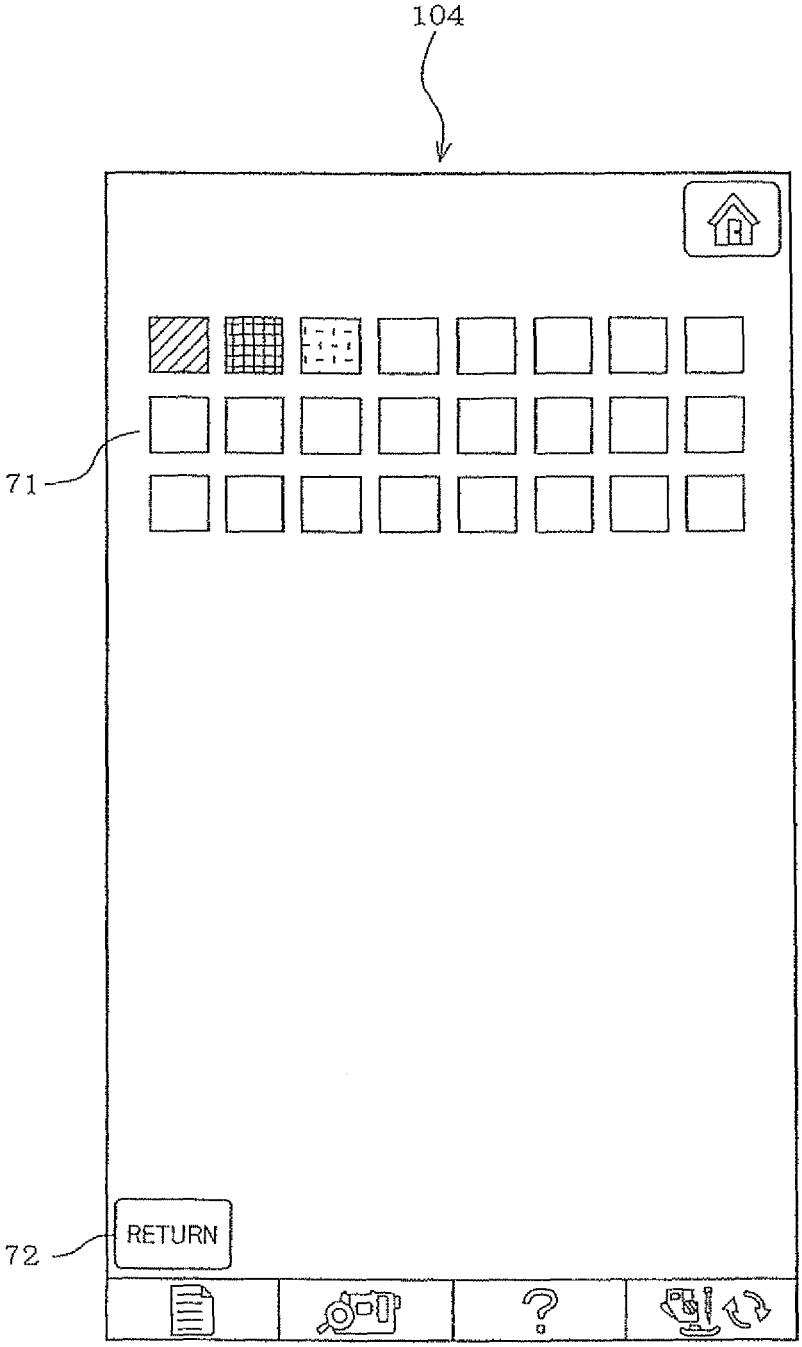
FIG. 12 is a view showing an example of a repository screen.

Next, a description will be given with reference to FIGS. 5 and 12 on the screens displayed on the LCD 9 during the generation of embroidery data and particularly during the coloring of the thread color data. FIGS. 5 to 12 illustrate screens 100 to 104 displayed on the LCD 9. Because the LCD 9 is a color display, contents of screens 100 to 104 such as embroidery pattern images and the first and second color palettes 56*a* and 56*b* can be displayed in various colors.

FIG. 5 exemplifies a coloring mode selection screen 100 used for coloring the embroidery data being generated. The coloring mode selection screen 100 comprises a preview image area 50 that displays a preview image, a mode specifier 51, a thread color data display area 52, a color count specifier 53, and palette selection keys 54*a* and 54*b*. A preview image is an image of the end result of an embroidery operation performed based on the embroidery data corresponding to the embroidery pattern selected by the user.

The mode specifier 51 is provided with keys 51*a* to 51*d* each associated with either of the "Random", "Vivid", "Soft", and "Gradation" modes discussed above. The color count specifier 53 is provided with plus and minus keys that, when touched, increments or decrements the total number of colors to be used as the thread color data of the embroidery data. For instance, when only 6 colors are specified by the color count specifier 53, the embroidery pattern is colored with only 6 colors. Touching the palette selection keys 54*a* or 54*b* invokes the first color edit screen 101A or the second color edit screen 101B.

Figure 6:
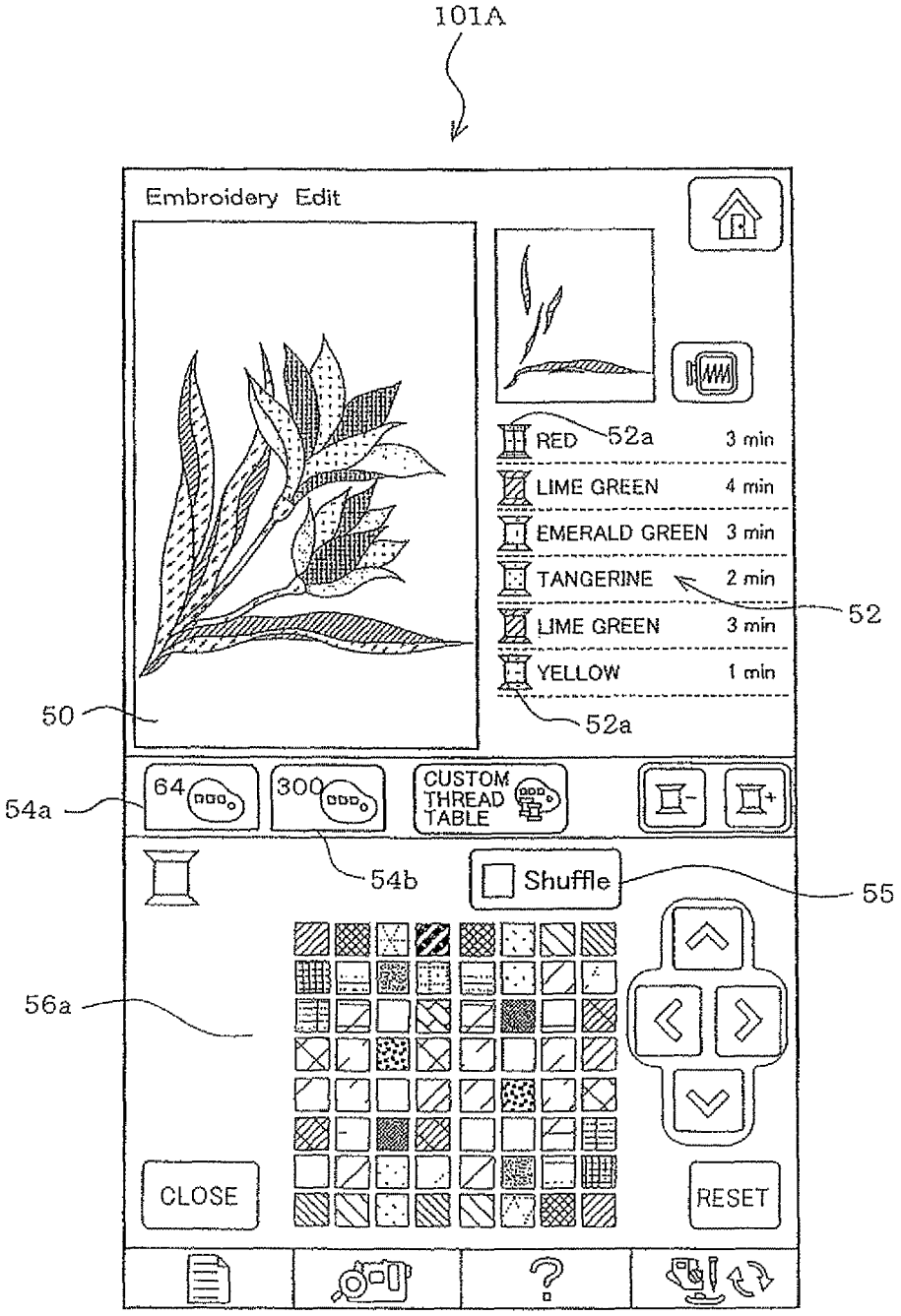
FIG. 6 is a view showing an example of a first color edit screen.

As shown in FIG. 6, the first color edit screen 101A comprises a shuffle key 55 and the first color palette 56*a* in addition to components such as the preview image area 50 and the thread color data display area 52. The thread color display area 52 provides a list of colors, along with icons of thread spools 52*a* representing the listed color, that are associated with the color-based pattern portions of the embroidery pattern displayed in the preview image area 50 as well as the sewing time allocated for each of the color-based pattern portions. The first color palette 56*a* contains 64 cells of colors arranged in 8 rows with each row containing 8 cells. Each of the 64 cells is assigned a palette-based color number of the first color palette 56*a*. For example, the 8 cells in the topmost row is assigned an RGB value of the palette-based color number 1 to 8 defined in the first palette table starting from the leftmost cell. The rest of the rows are numbered in similar manner up to number 64. Thus, the first color palette 56*a* contains 64 colors representing the color information contained in the first color table.

Figure 7:
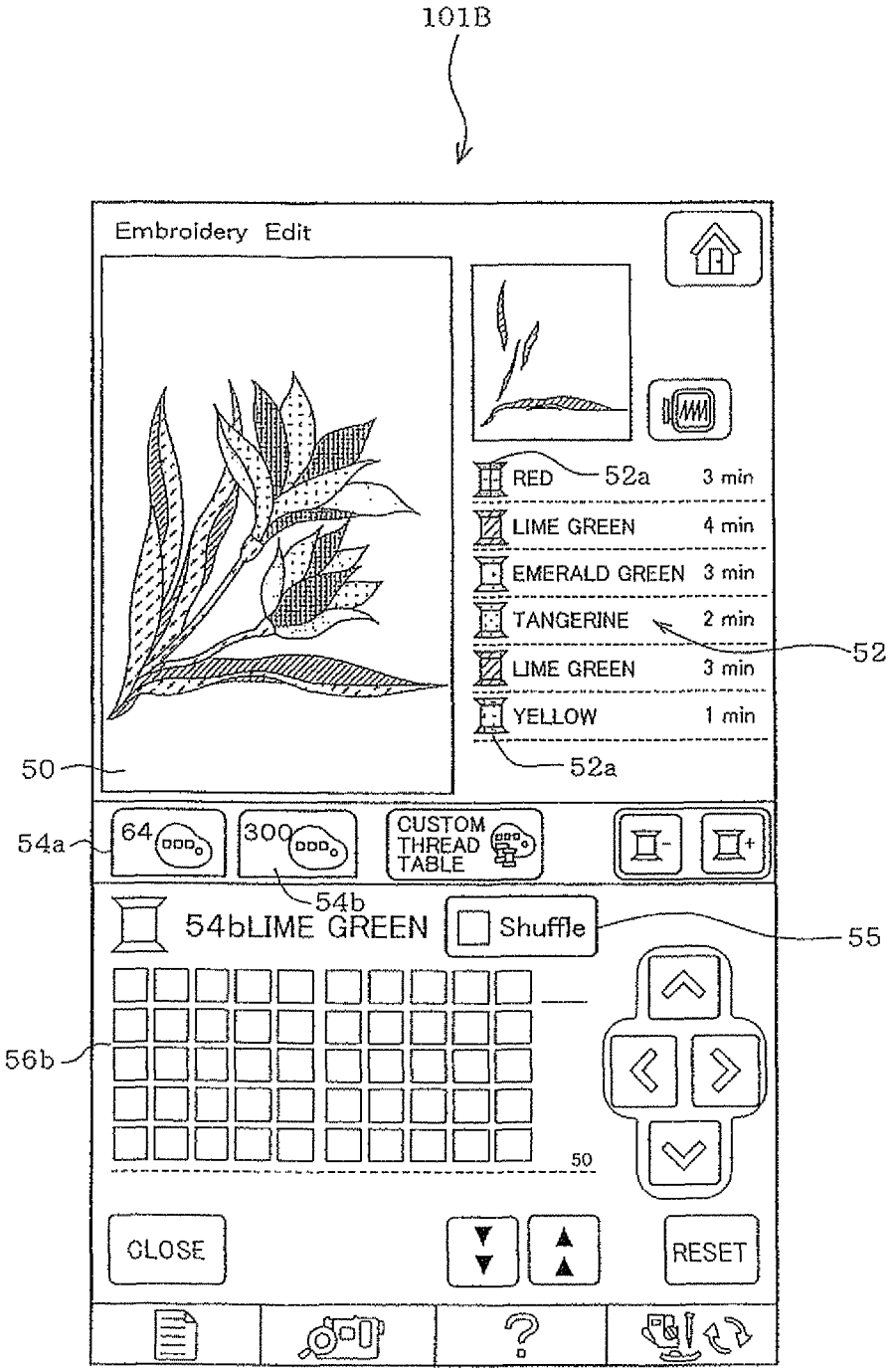
FIG. 7 is a view showing an example of a second color edit screen.

Referring now to FIG. 7, the second color edit screen 101B comprises the preview image area 50 just like the first color edit screen 101A and is provided with the second color palette 56*b* instead of the first color palette 56*a*. The second color palette 56*b* represents the second palette table and is capable of accommodating a maximum of 300 colors into 300 cells each associated with the RGB values of the color information. The second color palette 56*b* corresponds to the aforementioned custom palette table. FIG. 7 partially shows 50 out of the 300 cells of the second color palette 56*b*. The first and second color edit screens 101A and 101B are switched interchangeably by operating the pair of palette selection keys 54*a* and 54*b*. By operating the shuffle key 55, the process flow returns to the coloring mode selection screen 100.

Figure 8:
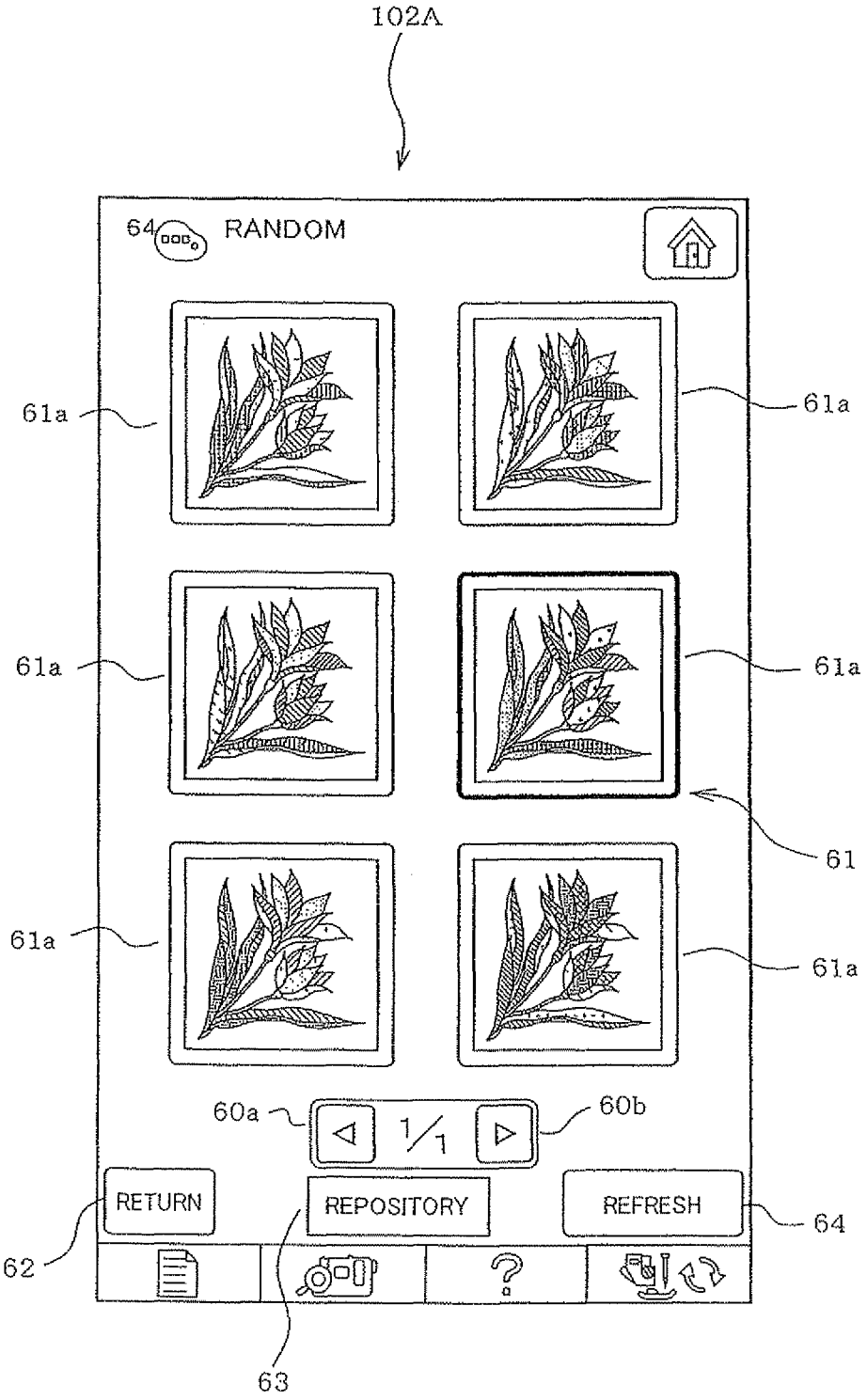
FIG. 8 is a view showing an example of a thumbnail screen.

In the coloring mode selection screen 100, either of the keys 51*a* to 51*d* associated with the coloring modes "Random", "Vivid", "Soft", and "Gradation" desired by the user is touched to execute the color assignment in the selected coloring mode. Responsively, a thumbnail screen 102A shown in FIG. 8 is displayed.

The thumbnail screen 102A comprises: an embroidery pattern selection area 61 which displays multiple embroidery patterns, such as 6 in number, a return key 62, a repository key 63, and a refresh key 64. The embroidery pattern selection area 61 displays shrunk thumbnail images 61*a* of embroidery patterns having unique combination of colors which were randomly assigned as the thread color data. Touching the refresh key 61 renews the color assignment of the thread color data and 6 new embroidery patterns are displayed in addition to the 6 embroidery patterns currently displayed.

Figure 9:
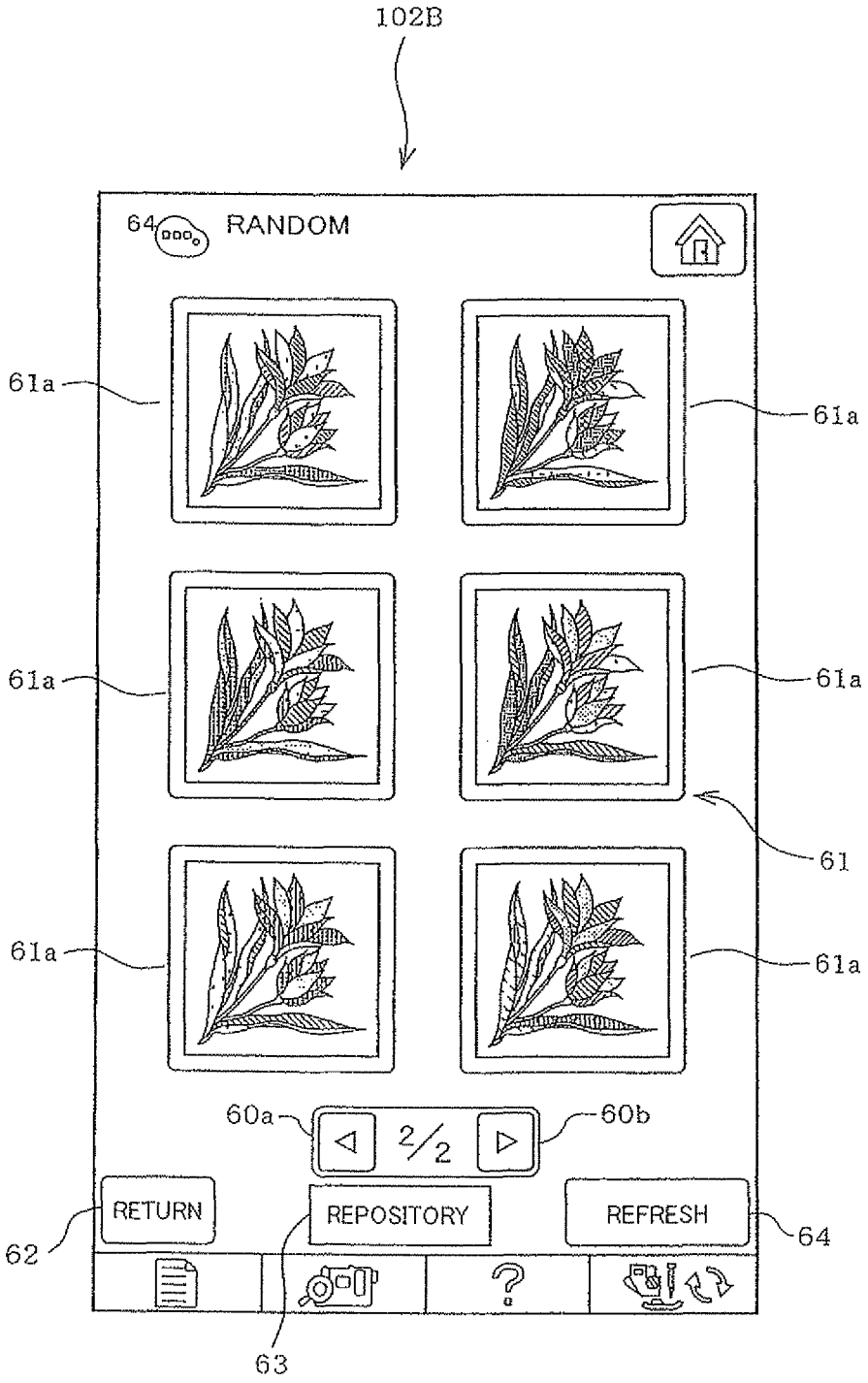
FIG. 9 is a view explaining how a plurality of thumbnail screens is managed.

FIG. 9 illustrates the 6 new embroidery patterns displayed on a new thumbnail screen 10213. Touching the refresh key 64 thus, allows additional variations of coloring samples to be generated and shown in the form of thumbnail images 61*a* across multiple screens 202A and 10213. The user may navigate between screens 102A and 10213 by touching navigation keys 60*a*, and 60*b* provided at the lower portion of each of the screens 102A and 10213. The fractions "1/1" and "1/2" appearing in the field located between the navigation keys 60*a* and 60*b* shown in FIGS. 8 and 9 represent the page numbers of screens 102A and 102B.

Operation of the return key 62 returns the process flow back to the coloring mode selection screen 100. Further, touching the thumbnail image 61*a* of the embroidery pattern in either of thumbnail screens 102A and 10213 invokes the enlarge screen 103 shown in FIG. 10.

The enlarge screen 103 comprises an enlarged image area 65, a close key 66, a set key 67, and a keep color key 68. The enlarged image area 65 provides an enlarged view of an embroidery pattern 40 corresponding to the selected thumbnail image 61*a* which is highlighted in bold frame in FIG. 8. If the user finds any color in the embroidery pattern 40 displayed in the enlarged image area 65, the user may touch the relevant color-based pattern portion. For instance, when the user touches the pattern portion 401, the outline of the pattern portion 401 is highlighted in bold frame colored distinctly from the color of the pattern portion 401 as shown in FIG. 11. When the keep color key 68 is touched in this state, the color of pattern portion 401 is stored in a priority color palette 71 provided on the repository screen 104 shown in FIG. 12. The touch panel 9*a* and the controller 21 are examples of a designating unit for allowing the user to designate a desired color to the thread color data from the choice of color-based pattern portions displayed on the enlarge screen 103.

Touching the set key 67 provided on the enlarge screen 103 returns the process flow back to the coloring mode selection screen 100 and populates the embroidery pattern displayed in the enlarged image area 65 into the preview image area 50 of the coloring mode selection screen 100. Touching the close key 66 provided on the enlarge screen 103 returns the process flow back to the thumbnail screen 102A or 102B.

The repository screen 104 is invoked by touching the repository key 63 provided on the thumbnail screen 102A and 1025. The repository screen exemplified in FIG. 12 is provided with the priority color palette 71 comprising a matrix of 24 cells and a return key 72. The color information of the color designated by the user through the designating unit is registered in sequence from the left uppermost cell. The priority color palette 71 allows a visual recognition of the colors designated by the designating unit at a glance through the screen. When the return key 72 of the repository screen 109 is operated, the process flow returns to the thumbnail screen 102A or 1025. In the present embodiment, the priority color palette 71 is configured to hold a maximum of 29 colors, but it may be arranged to hold more or less than 24 colors as found appropriate.

In the present embodiment, the repository storage area 248 within the RAM 24 is configured to store a priority palette table which provides a mapping between a maximum of 24 entries of RGB values and palette-based color numbers ranging from 1 to 24.

The controller 21, when executing random extraction, is configured to prioritize the colors stored in the priority palette table, i.e. the repository storage area 248 over the colors stored in the first or the second palette table. Each of the extracted colors is assigned to the thread color data of each color-based pattern portion. The above described configuration facilitates generation of the embroidery data through random coloration while allowing the use of colors in accordance with the preference and sensibility of the user.

With reference to FIGS. 13A to 16, the operation of an embroidery data processing program will be described with an emphasis on the coloring of the thread color data. FIGS. 13A to 16 are flowcharts indicating the flow of processes executed by the controller 21 based on the embroidery data processing program.

The user reads the embroidery data from the ROM 23 by operating the touch panel 9*a* to display a pattern selection screen not shown on the LCD 9. When the desired embroidery pattern is selected from the multiple embroidery patterns displayed on the pattern selection screen by touching the desired embroidery pattern, the coloring mode selection screen 100 illustrated in FIG. 5 is invoked that displays the selected embroidery pattern as identified as step A1 in the flowchart of FIG. 13A.

When either of the palette selection keys 54*a* and 54*b* is touched in the coloring mode selection screen 100, the palette flag is either set or reset. Based on the status of the flag, the controller 21 judges which of the palettes 56*a* or 56*b* is to be used for the random coloring in the subsequent steps such as step C1. Further, at step A1, the plus key and the minus key of the color count specifier 53 provided in the coloring mode selection screen 100 are operated to specify the total count of colors to be used in the coloring of the selected embroidery pattern, which is also referred to as specified coloring count "x".

Figure 14:
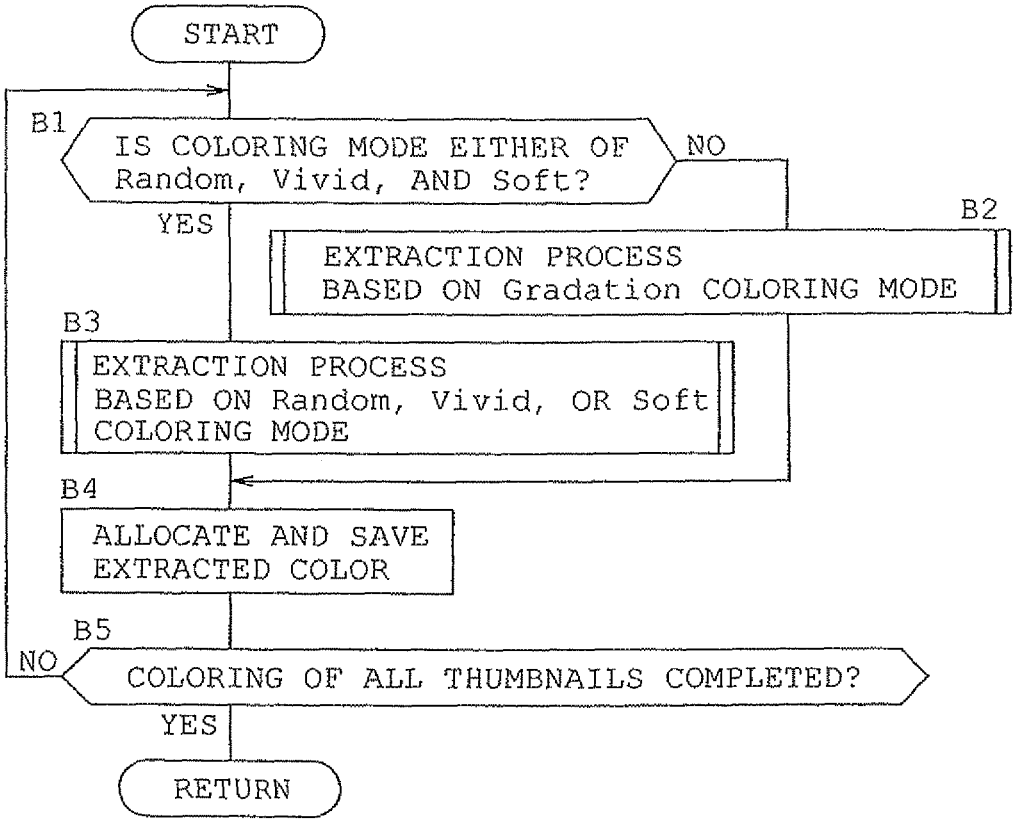
FIG. 14 is a flowchart showing a random color assignment process.

Then, at step A2, the coloring mode is specified by the operation of either of the keys 51*a* to 51*d* associated with either of "Random", "Vivid", "Soft", and "Gradation", whereafter the process proceeds to step A3 indicated in FIG. 14 to execute the random coloring process.

At step B1 of the random coloring process, a judgment is made as to whether or not either of the coloring modes "Random", "Vivid", and "Soft" has been specified. If neither are specified (step B1: NO), meaning that "Gradation" has been specified, the process proceeds to step B2 indicated in FIG. 15 to execute the extraction process based on the "Gradation" coloring mode.

In the "Gradation" coloring mode, the controller 21 refers to the palette flag. If it is found, for instance, that the first color palette 56*a* is set, a random number ranging within the number of colors present in the palette is produced at step C1, which range is 1 to 64 in this case. Then, color-based palette numbers 1-64 of the first palette table is searched to find the number that matches the produced random number and the color corresponding to the matching color-based palette number is selected as the base color. Then at step C2, the controller 21 further calculates the HSV value based on the RGB value of the selected base color to specify a range represented as threshold $H_{G1}$ and $H_{G2}$ centering on the calculated Hue H.

Thereafter, at step C3, the controller 21 first extracts colors from the priority palette table. At this instance, however, the user has not designated any colors using the designating unit and thus, there are no colors stored in the repository storage area 248 (step C4: NO) at this point in time. Thus, at step C5, the controller 21 calculates Hue H based on the RGB value of the color represented by palette-based color number 1 of the first palette table and judges whether or not the calculated hue H falls within the range of threshold $H_{G1}$ and $H_{G2}$. If the calculated hue H falls within threshold $H_{G1}$ and $H_{G2}$ the color represented by palette-based color number 1 of the first palette table is stored in the color information storage area 247 as a color belonging to the "Gradation" category. The same process is repeated one by one for the palette-based color number 2 and beyond stored in the first palette table. Thus, the colors within the first palette table having been classified as the "Gradation" category become selected as the target of extraction and the updated information is stored in the color information storage area 247.

Having completed the selection from the 64 colors, the count of colors selected from the priority palette table at step C3, which amounts to zero at this point in time, and the count of colors selected from the first palette table are added to obtain a sum which is compared with the specified coloring count "x" at step C6 to judge whether or not the sum is equal to or greater than the specified coloring count "x". If the sum is less than the specified coloring count "x" (step C6: NO), a judgment is made to specify a new base color at step C7 and the process returns to step C1 to reproduce a random number as described earlier. Steps C1 to C7 are repeated and if the sum of the colors selected base on the base color becomes equal to or greater than the specified coloring count "x" (step C6: YES), "x" colors are selected from the selected colors at step C8.

In the extraction process, a random number is produced within the range of total count of selected colors stored in the color information storage area 247. The produced random number is compared with the palette-based color numbers of the selected colors and the RGB value associated with the matching palette-based color number is extracted. As described above, a random number is used to randomly extract "x" unique colors from the color information storage area 247. The extracted color is stored in the extracted data storage area 249 of the RAM 24 and the process flow returns to step B4 indicated in FIG. 14.

At step B4, the randomly extracted colors are each assigned to the thread color data of each of the color-based pattern portions. Prior to the assignment process, the specified coloring count "x" is subtracted from the total count "n" of the color-based pattern portions, and in case of any deficiencies, in other words, if $n-x>0$, an additional selection process is executed. That is, additional colors are selected from the color information storage area 247 in order to equalize the total count n of color-based pattern portions and the count of colors within the extracted data storage area 249. The selected colors are additionally stored in the extraction data storage area 249 such that the number of entries of colors within the extraction data storage area 249 equals the total count "n" of color-based pattern portion. Then, the entries of colors stored in the extraction data storage area 249 are shuffled prior to the assignment process. That is, because the extraction data storage area 249 contains multiple entries of the same color as the result of the additional selection process, the entries are shuffled so that they are arranged in random order. After a color has been assigned to each of the "n" number of color-based pattern portions to complete the coloring of the first embroidery pattern, all of the thread color data associated with the first embroidery pattern is stored in the RAM 24.

In the present embodiment, 6 unique embroidery patterns are displayed on the thumbnail screen 102A. Thus, the second to sixth embroidery patterns (step B5: NO) are additionally generated through steps B1, B2, B4, and B5. If the generated embroidery pattern is found to be distinct from those previously generated, the thread color data associated with the currently generated embroidery pattern is stored at step B4 as was the case for the first embroidery pattern. Thus, steps B1, B2, B4, and B5 are repeated until all the embroidery patterns to be displayed as thumbnails have been generated (step B5: YES) to provide 6 unique embroidery patterns under the "Gradation" coloring mode.

In case either of the "Random", "Vivid", and "Soft" coloring mode was specified at step B1 (step B1: YES), the extraction process identified as step B3 and detailed in FIG. 16 is executed instead of step B2.

Referring to the flowchart in FIG. 16, if no colors are registered with the priority color palette (step D1: YES), no colors can be retrieved from the priority palette table (step D7: NO). The symbol "T" indicated in step D7 of the flowchart represents the resultant count of colors extracted based on the colors stored in the priority palette table after having undergone the later described steps D2 to D6.

The controller 21, when making a judgment that the first color palette 56*a* has been selected, for instance, based on the status of the palette flag, proceeds to step D8 to select a color meeting the requirements of the selected coloring mode from the first color palette.

For example, in case the "Random" coloring mode is selected, neither of thresholds $S_v$, $S_{S1}$ $S_{S2}$ $H_{G1}$ nor $H_{G2}$ is specified and thus, the RGB values associated with palette-based color numbers 1 to 64 are stored as they are in the color information storage area 247 of the RAM 24. In other words, if no category is specified, the entries of 64 colors in the first palette table are stored intact within the color information storage area 247.

In case the "Vivid" or "Soft" coloring mode has been specified, saturation S is calculated based on the RGB value of palette-based color number 1. Then a judgment is made as to whether the calculated saturation S is greater than threshold value $S_v$, or within the range of threshold $S_{S1}$ to $S_{S2}$. In case saturation S of palette-based color number 1 is greater than threshold value $S_v$, or within the range of threshold $S_{S1}$ to $S_{S2}$, palette-based color number 1 is stored in the color information storage area 247 with the categorization of "Vivid" or "Soft". Similarly, for colors associated with palette-based color number 2 and onwards, saturation S is calculated based on the read RGB value for comparison with threshold $S_v$ or the range of threshold $S_{S1}$ to $S_{S2}$, and a judgment is made as to whether or not to store the information to the color information storage area 247. As described in this example in which the "Vivid" or "Soft" coloring mode has been specified and the first palette table has been selected, the colors belonging to the "Vivid" or "Soft" category become selected from the 64 colors of the first palette table and are stored in the color information storage area 247 with the updated information.

After the colors belonging to the "Random", "Vivid", and "Soft" coloring modes have been selected, the count of colors amounting to the difference of specified coloring count "x" and color count "T", indicating the colors extracted through steps D2 to D6 and amounting to 0 at this instance (T=0), is extracted at step D9 from the selected colors. The extraction process utilizes a random number produced in the aforementioned manner to randomly extract "x" unique colors. The extracted colors are stored in the extraction data storage area 249 of the RAM 24 and the process flow returns to step B4 of the flowchart indicated in FIG. 14.

At step B4, the assignment process similar to the process executed in the "Gradation" coloring mode is executed, and on completing the generation of the first of the six embroidery patterns, the entire thread color data for the first embroidery pattern is stored in the RAM 24. Thus, for the second embroidery pattern and onwards, steps B1, B3, B4, and B5 are repeated until all the embroidery patterns to be displayed as thumbnails have been generated (step B5: YES). Thus, 6 unique embroidery patterns under the "Random", "Vivid", or "Soft" coloring mode are generated and the process flow returns to step A4 of the flowchart indicated in FIG. 13.

The controller 21 is one example of a first assigning unit, which, in step A3 or the later described step A14, executes a first assigning routine that randomly extracts colors to be used as thread color data for each color-based pattern portion from the first or the second palette table when no colors are specified in the priority palette table and assigns the extracted colors to each of the color-based pattern portions. More precisely, the first assigning unit includes a first extracting unit that executes the aforementioned steps B2 and B3 and a first assigning unit in a narrower sense that executes the aforementioned step B4.

At step A4, a first display routine is executed that displays to the thumbnail screen 102A shrunk thumbnail images of multiple embroidery patterns, 6 of which are shown in FIG. 8, generated in the selected coloring mode. When either of the thumbnail images 61*a* are touched (step A5: YES), the enlarge screen 103 shown in FIG. 10 is invoked at step A6. The enlarge screen 103 provides an enlarged view of the selected thumbnail image 61*a*.

If the user finds any color of his/her preference in the embroidery pattern 40 shown in the enlarged image area 65, the user may touch the relevant color-based pattern portion (step A7: NO, step A8: YES). For instance, when the user touches the pattern portion 401, the outline of the pattern portion 401 is highlighted in bold frame colored distinctly from the color of the pattern portion 401 (step A9). When the keep color key 68 is touched in this state (step A10: YES), the color of the pattern portion 401 is stored in the repository storage area 248 of the RAM 24 and registered with the priority color palette 71 at step A11. Operation of the close key 66 provided in the enlarge screen 103 returns the process flow back to thumbnail screen 102A (step A12: YES). The aforementioned steps A8 and A9 are examples of a designating routine which allows the designation of the desired colors for used as the thread color data by the designating unit. The aforementioned steps A10 and A11 are examples of a storing routine that stores the colors designated by the designating routine to the second storage.

Touching the refresh key 64 provided on the thumbnail screen 102A (step A13: YES) executes a random coloring process similar to the process executed in step A3 (step A14). As a result, newly extracted colors are assigned to the thread color data and the thumbnail screen 102B being separate from the thumbnail screen 102A and displaying 6 new embroidery patterns as shown in FIG. 9 is invoked (step A4). Thus, the user is allowed to display multiple randomly colored embroidery patterns over multiple screens 102A and 102B. Further, if the user finds any color of his/her preference in the embroidery patterns, the user may enlarge the relevant embroidery pattern and touch the color-based pattern portion (step A5 to A10) to register a new color with the repository storage area 248 (step A11). Thus, the RGB values of one or more colors registered or designated by the user as well as the palette-based color number associated with the RGB value are added to the priority palette table of the repository storage area 248.

The colors stored in the priority palette table can be viewed by touching the repository key 63 provided on the thumbnail screen 102A and 1025 (step A15: YES, step A16). More specifically, the repository screen 109 is provided with the priority color palette 71 which displays the colors designated by the user. Though only 3 colors are registered with the priority color palette 71 exemplified in FIG. 12, the priority color palette 71 has a capacity to allow the user to readily register multiple colors of his/her preference from the multiple embroidery patterns displayed. Touching the return key 72 in the repository screen 104 returns the process flow back to the thumbnail screen 102A or 1023 (step A17: YES).

In case the return key 62 provided on the thumbnail screens 102A and 1023 is touched (step A18: YES), the process flow is returned to the coloring mode selection screen 100, meaning that the process flow is returned to step A1. Thus, the user is allowed to reset various settings such as the selection of the palette 56*a* or 56*b* used in the random coloring, the specification of coloring count "x", and the coloring mode, and proceed to execute the random coloring process at step A3. In the random coloring process at step A3 or the random coloring process of step A14 triggered by another operation of the refresh key 64 (step A13: YES), the use of colors registered with the priority color palette 71 is prioritized over the colors registered with the first color palette 56*a* and the second color palette 56*b*.

In the extraction process based on "Gradation" coloring mode at step B2, the selection of colors stored in the priority palette table indicated as step C3 of the flowchart of FIG. 15 is prioritized over the selection of colors stored in the first or the second palette table indicated as step C5 of the same flowchart. As described earlier, thresholds $H_{G1}$ and $H_{G2}$ are specified based on the selected base color at steps C1 and C2 and at step C3, a judgment is made as to whether or not hue calculated for the colors stored in the priority palette table falls within threshold $H_{G1}$ and $H_{G2}$. Then, the colors belonging to the "Gradation" category is selected from the colors within the priority palette table and stored in the color information storage area 247.

After the selection from the priority palette table has been completed, a judgment is made as to whether or not the count of the selected colors is equal to or greater than the specified coloring count "x" at step C4 and if not (step C4: NO), the colors falling within the range of thresholds $H_{G1}$ and $H_{G2}$ are selected from the first or the second palette table as well (step C5). Then a judgment is made as to whether or not the sum of count of colors selected from the priority palette table at step C3 and the count of colors selected from the first or the second palette table is equal to or greater than the specified coloring count "x" (step C6) and if not, the base color is renewed as indicated in steps C7 and C1. Steps C1 to C7 are repeated until the count of colors selected based on the base color becomes equal to or greater than the specified coloring count "x" (step C6: YES), whereafter "x" colors are extracted from the plurality of colors at step C8.

The color information storage area 247 is configured to prioritize the storage of colors selected from the priority palette table over the colors selected from the first or the second palette table. In case a YES judgment is made at step C4, only the colors selected from the priority palette table is stored in the color information storage area 247. As a result, the colors stored in the priority palette table, if any, will always be stored and extracted with the utmost priority. Thus, in the "Gradation" coloring mode indicated as step B2 in the flowchart of FIG. 14, the colors selected from the priority color palette 71 are randomly extracted with priority and the extracted colors are assigned to the color data of each color-based pattern portion at step B4. As described earlier, the present embodiment executes the above described coloring process indicated in steps B1, B2, B4, and B5 to generate 6 embroidery patterns at a time and displays thumbnail images of the generated embroidery patterns on the thumbnail screen 102A at step A9 in the flowchart of FIG. 13A.

Further, even when either of the "Random", "Vivid", or "Soft" coloring mode is selected (step B3 of FIG. 14), the colors registered with the priority color palette 71 will be used with priority if any colors are registered with the priority color palette 71 by the user.

More specifically, a judgment is made as to whether or not color count R of the priority palette table is 0 at step D1 and if not (step D1: NO), the color (s) are acquired from the priority palette table in step D2.

In case the "Random" coloring mode is selected, neither of thresholds $S_v$, $S_{S1}$ $S_{S2}$ $H_{G1}$ nor $H_{G2}$ are specified as mentioned earlier, and thus, the RGB values associated with the colors stored in the priority palette table are stored as they are in the color information storage area 247 of the RAM 24. In contrast, in case either of the "Vivid" or "Soft" category is specified as the coloring mode, a judgment is made on the colors stored in the priority palette table based on saturation S calculated from the RGB value of each color to determine whether or not saturation S is greater than threshold $S_v$ or whether or not saturation S is within the range of threshold $S_{S1}$ to $S_{S2}$. Based on the judgment, the colors within the priority palette table that have been classified into the "Vivid" or "Soft" category are selected and stored in the color information storage area 247.

Then, a judgment is made as to whether or not the count "R'" of colors selected from the priority palette table is 0, and if not (step D3: NO), a judgment is made at step D4 as to whether or not the selected color count "R'" is greater than specified color count "x". If the selected color count "R'" is greater than the specified color count "x" (step D4: NO), "x" colors are randomly extracted from the priority palette table at step D6. As a result, the final count "T" (T=x) of colors extracted by way of step D6 is stored in the extraction data storage area 249. In case the selected color count R' is equal to less than the specified coloring count "x" (step D4: YES, i.e. $0<R'\leq x$), the colors selected at step D2 is stored as they are in the extraction data storage area 249 at step D5.

At step D7, a judgment is made as to whether or not count "T" of the colors extracted by way of steps D2 to D6 matches the specified coloring count "x" (step D7: YES, i.e. T=x) and if not (step D7: NO), the difference is compensated by selecting additional colors from the first or the second palette table at step D8 and the selected colors are extracted at step D9. More specifically, when the "Random" coloring mode is selected, the colors stored in the first or the second palette table are stored as they are in the color information storage area 247 as described earlier. In case "Vivid" or "Soft" category is specified as the coloring mode, the colors specified in the first or the second palette table are selected for classification into the "Vivid" or "Soft" category based on thresholds $S_v$, $S_{S1}$, and $S_{S2}$. Thus, after additionally selecting colors belonging to either of the "Random", "Vivid", and "Soft" categories at step D8, the count of colors amounting to the difference between the specified coloring count "x" and count "T" of colors extracted by way of steps D2 to D6 (x−T) are randomly extracted from the selected colors at step D9. The extracted colors are stored in the extraction data storage area 249 in addition to the colors having been selected form the priority palette table.

The color information storage area 247 is configured to prioritize the storage of colors selected from the priority palette table over the colors selected from the first or the second palette table. In case a YES judgment is made at step D7 by way of step D6, only the colors selected from the priority palette table is stored in the extraction data storage area 249. Thus, when operating under either of the "Random", "Vivid", and "Soft" coloring modes indicated as step B3 in the flowchart of FIG. 14, the colors stored in the priority color palette 71 are extracted with priority and assigned to the color data of each of the color-based pattern portion at step B4. As described earlier, the present embodiment executes the above described coloring process indicated in steps B1, B3, B4, and B5 to generate 6 embroidery patterns at a time and displays thumbnail images of the generated embroidery patterns on the thumbnail screen 102A at step A4 of the flowchart of FIG. 13A.

As described above, the controller 21 is one example of a second assigning unit, which, in step A3 or the later described step A14, executes a second assigning routine that prioritizes the extraction of colors from the repository storage area 248 or more specifically from the priority palette table. More precisely, the second assigning unit includes a second extracting unit that executes the aforementioned steps B2 and B3 and a second assigning unit in a narrower sense that executes the aforementioned step B4. Step A1 executed after the second assigning routine is one example of a second display routine.

The assignment process executed by the second assigning unit utilizes the colors specified by the user and thus, is more likely to be successful in generating a coloring sample of the embroidery pattern, presented in the form of thumbnail image 61*a*, that is desired by the user as compared to the assignment process executed solely by the first assigning unit. If the user finds a color that he/she likes, the user may touch the relevant thumbnail image 61*a* (step A5: YES) to invoke the enlarge screen 103 at step A6 and further touch the set key 67 (step A7: YES). As a result, the process flow returns to step A19 in which a screen transition is made back to the coloring mode selection screen 100 which now shows a preview image of the embroidery pattern which was displayed in the enlarged image area 65 to end the process.

As described above, the controller 21 of the embroidery data generator 30 executes the first assigning routine that randomly extracts colors from the first or the second palette table stored in the first storage and assigns the extracted colors to the thread color data of each color-based pattern portion. The controller 21 further executes a first display routine that displays on the screen the image of the embroidery pattern having its color-based pattern portions colored in the colors assigned by the first assigning routine. Still further, the controller 21 executes a designating routine and a storing routine in which the color desired by the user is designated from the color-based pattern portions of the embroidery pattern displayed by the first display routine and the designated color is stored in the second storage. Then the controller 21 executes the second assigning routine that prioritizes the execution of the assignment process based on the priority palette stored in the second storage.

According to the above described configuration, the primary coloring executed by the first assigning routine readily achieves coincidental and out-of-the-ordinary coloring of the embroidery pattern. Further, because the embroidery pattern is displayed on the screen, visual recognition of the colors assigned to the color-based pattern portions comes with ease.

Further, the secondary coloring executed by the second assigning routine allows the colors designated by the user from the color-based pattern portions displayed on the screen to be assigned with priority over other colors. This facilitates generation of embroidery data while incorporating the colors desired by the user into the embroidery pattern.

The first display routine displays multiple embroidery patterns on the thumbnail screens 102A and 1025. The combination of colors assigned to the color-based pattern portions in each embroidery pattern is unique. The designating routine designates a color the user wishes to assign to the thread color data from the color-based pattern portions of the embroidery patterns displayed on screens 102A and 102B. According to such configuration, the user is allowed to readily designate the desired color while viewing the look of the colored embroidery pattern displayed on screens 102A and 102B.

The controller 21 comprises an enlarging unit that displays an enlarged image of only the desired embroidery pattern to the enlarge screen 103 among the choice of multiple embroidery patterns. In the designating routine, the controller 21 is configured to designate the desired color from the color-based pattern portions of the enlarged embroidery pattern. The enlarged image of the embroidery pattern improves the visibility of the embroidery pattern and allows the embroidery pattern to be viewed in detail. Thus, the designation of color assigned to a small color-based pattern portion can be done with ease.

Similarly, the enlarging feature facilitates the designation of color in sewing machines that only come with a small LCD.

The displaying unit displays the embroidery pattern in the color assigned to each color-based pattern portion by both the first assigning unit and the second assigning unit. This facilitates the visual recognition of the colors assigned to the color-based pattern portions. More specifically, the first display routine allows a visual recognition of the colors assigned by the first assigning routine and the second display routine allows a visual recognition of the colors assigned by the second assigning routine.

The controller 21 and the touch panel 9*a* responsible for the execution of steps A13 and A14 are examples of a re-coloring unit that re-executes, in response to user instructions, the assignment process by the first assigning routine or the second assigning routine. The re-coloring unit allows the repetition of color extraction and assignment. Thus, the embroidery data of the embroidery patterns displayed on the thumbnail screens 102A and 102B may be re-colored to the satisfaction of the user through the execution of the re-coloring unit.

More specifically, in response to user instructions, the controller 21 executes a first re-coloring routine that re-executes the first assigning routine or a second re-coloring routine that re-executes the second assigning routine as steps A13 and A14. The controller 21 further executes a first re-displaying routine as step A4 after the execution of the first re-coloring routine and a second re-displaying routine as step A4 after the execution of the second re-coloring routine. Thus, the embroidery data of the embroidery patterns displayed on the thumbnail screens 102A and 102B may be re-colored to the satisfaction of the user through the execution of the first or the second re-coloring routine.

The disclosure is not limited to the foregoing embodiment but may be modified or expanded as follows.

The embroidery data generator need not be provided within the sewing machine M but may be incorporated in a readily available personal computer or a dedicated computer machine provided with components such as a mouse, a keyboard, a memory card connector, and a display.

In case the sewing machine and the embroidery data generator are configured separately unlike the embodiment discussed above, the sewing machine and the embroidery data generator may exchange data through wire or wireless communication.

The first and the second storages are not limited to the RAM 24 or the EEPROM 25 but may be configured as other types of internal storage incorporated in the sewing machine or the embroidery data generator, or as a removable external storage detachably attached to the sewing machine or the embroidery data generator. For instance, the second storage may be configured by a nonvolatile storage medium such as an EEPROM instead of the RAM 24. A storage configured by a nonvolatile memory allows the color designated by the designating unit to be retained even after the sewing machine M is turned off.

In the embodiment discussed above, the extraction process is performed randomly by the first or the second extraction unit at steps B2 or B3. Further, the extracted colors are assigned by the first or the second assigning unit after being shuffled at step B4, thereby enabling a random assignment. In an alternative embodiment, either the extraction (step B2/B3) or the assigning (step B4) may be executed at random.

Figure 13A:
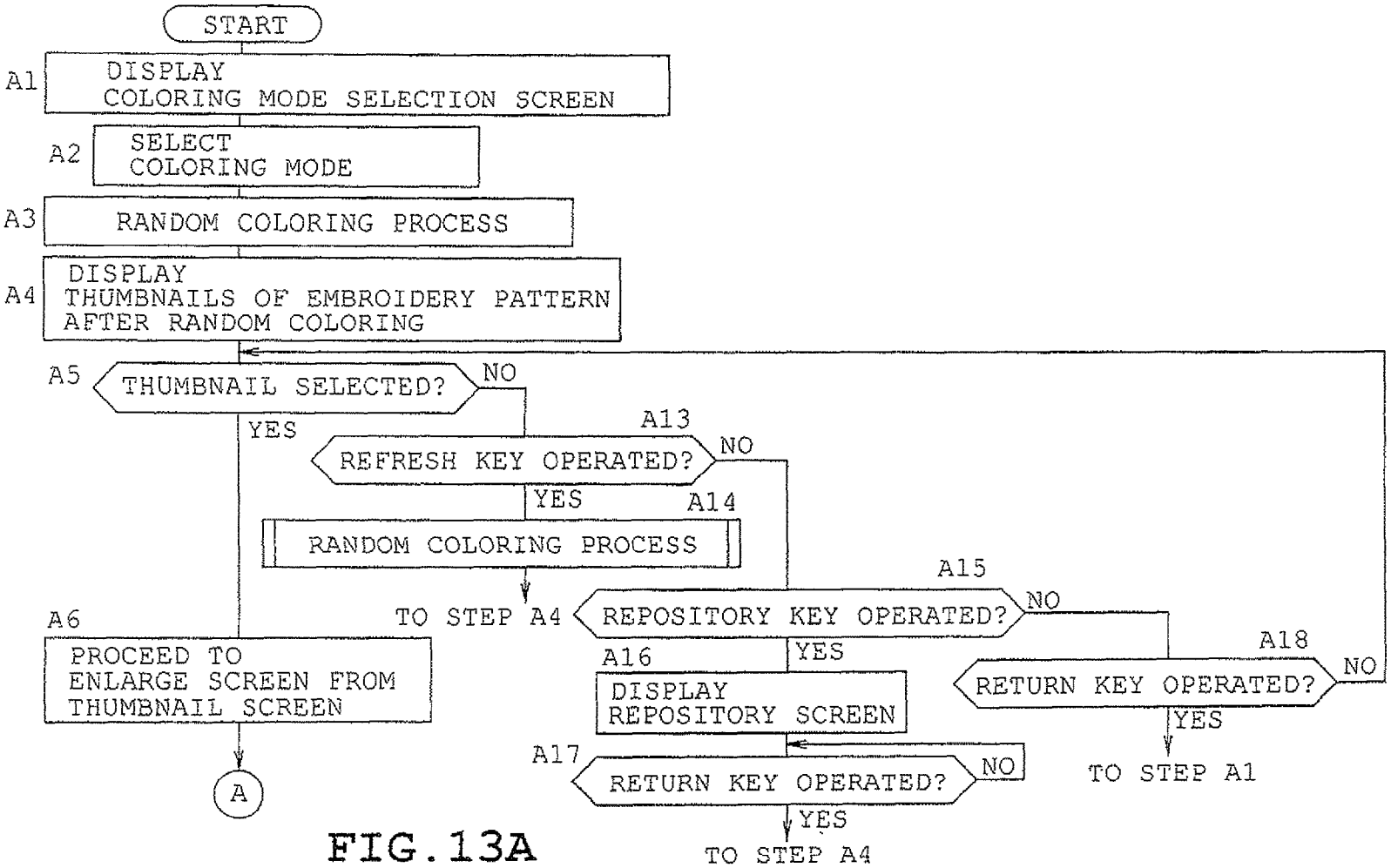
FIGS. 13A and 13B are flowcharts showing an entire process to set a thread color data in an embroidery data generation process.
Figure 13B:
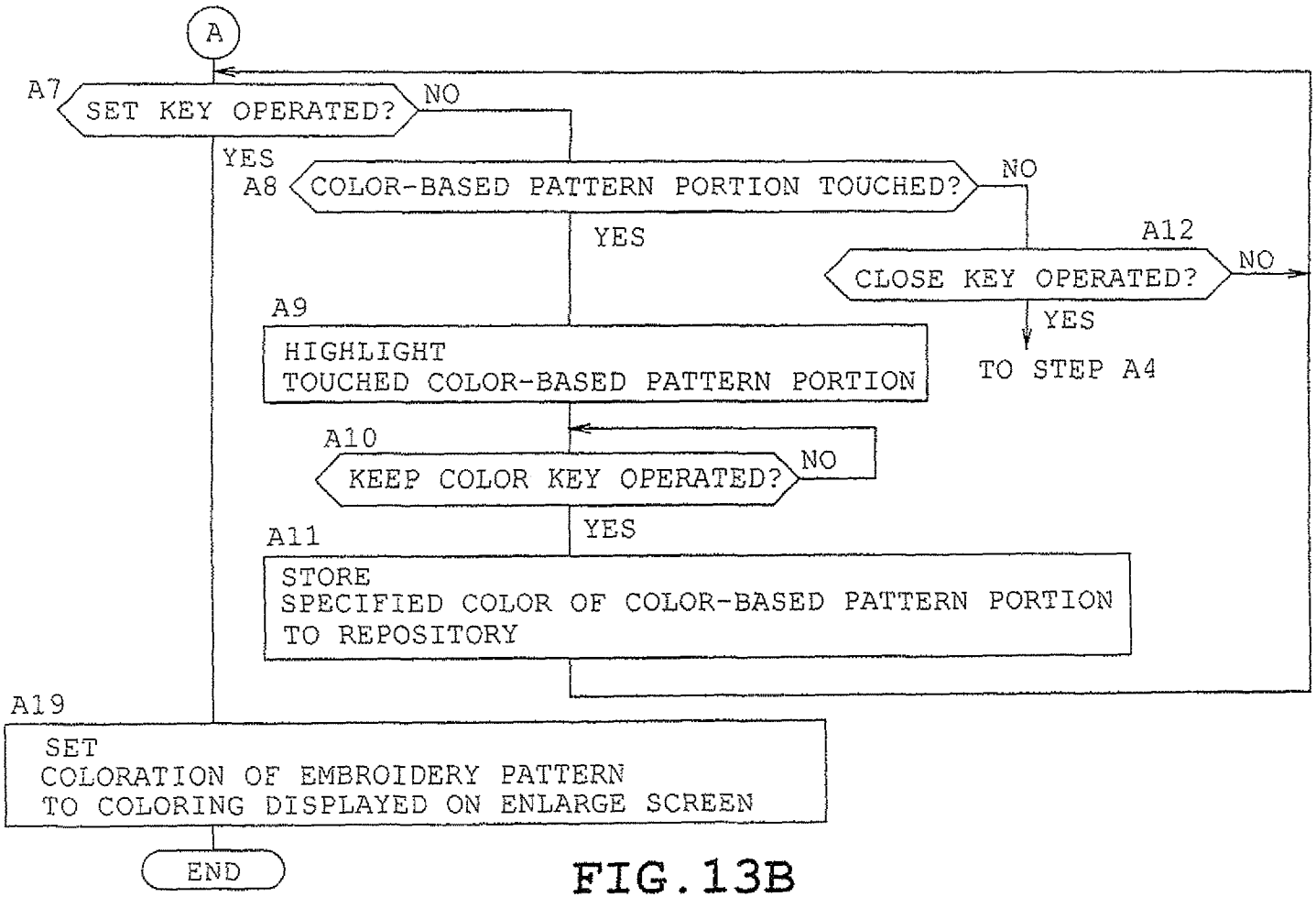

The transition between the screens 100 to 104 is not limited to the flow indicated in FIGS. 13A and 13B and may be modified as desired. For instance, if the return key 72 is operated at step A17 of the flowchart of FIG. 13A, the process may return to step A1 such that the transition is made from the repository screen 104 to the coloring mode selection screen 100. According to such configuration, the user is allowed to check the content of the priority color palette 71 in the repository screen 104 and proceed immediately to the execution of the coloring process by the first or the second assigning unit after specifying the coloring mode in the coloring mode selection screen 100. This provides a user friendly system in which the embroidery patterns can be colored through settings made based on visual recognition provided through the transition of the screens.

The computer readable recording medium that stores the embroidery data processing program is not limited to the ROM 23 provided in the controller 21 but may be configured by a CD-ROM, a flexible disk, a DVD, a memory card 11, or the like. In such case, the computer readable recording medium is read and executed through the computer of a controller provided in the embroidery data generator to provide operation and effects similar to those of the above described embodiment.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

I claim:

1. A data generator comprising:

a memory configured to store a plurality of predetermined colors; and a processor configured to control the data generator to:

assign a color, which is extracted randomly from the plurality of predetermined colors, as a thread color data of each of a plurality of color-based pattern portions, the thread color data identifying a color of the color-based pattern portion, and the plurality of color-based pattern portions being included in a embroidery pattern;

display the embroidery pattern to a screen with the color assigned to each of the plurality of color-based pattern portions;

designate a color of the thread color data from each of the plurality of color-based pattern portions included in the displayed embroidery pattern; and allocate the designated color with priority over the plurality of predetermined colors for each of the plurality of color-based pattern portions.

2. The data generator according claim 1, wherein displaying the embroidery pattern comprises displaying a plurality of embroidery patterns to the screen, the plurality of embroidery patterns having different combinations of colors assigned to the plurality of color-based pattern portions, and wherein designating the color of the thread color data comprises designating the color of the thread color from each of the plurality of color-based pattern portions in the plurality of embroidery patterns displayed in the screen.

3. The data generator according claim 2, wherein displaying the embroidery pattern comprises displaying some of the plurality of embroidery patterns to the screen in an enlarging manner, and wherein designating the color of the thread color data comprises designating the color of the thread color from each of the plurality of color-based pattern portions in the plurality of embroidery patterns displayed in the screen in the enlarging manner.

4. The data generator according claim 1, wherein displaying the embroidery pattern comprises displaying the embroidery pattern in the color assigned based on a first group of colors extracted randomly from the plurality of predetermined colors and/or a second group of colors designated from each of the plurality of color-based pattern portions included in the displayed embroidery pattern.

5. The data generator according claim 4, wherein the processor is further configured to control the data generator to:

repeat, after the embroidery pattern has been displayed in the screen, either of assigning the color extracted randomly from the plurality of predetermined colors and allocating the designated color with priority over the plurality of predetermined colors based on an input to the data generator, and wherein displaying the embroidery pattern comprises displaying, when a new embroidery pattern including a new combination of colors assigned to the plurality of color-based pattern portion is created by the repeating, the created embroidery pattern.

6. A non-transitory computer readable recording medium storing computer readable instructions that, when executed, cause a data generator to assign a color, which is extracted randomly from a plurality of predetermined colors stored in a memory, as a thread color data of each of a plurality of color-based pattern portions, the thread color data identifying a color of the color-based pattern portion, and the plurality of color-based pattern portions being included in a embroidery pattern;

display the embroidery pattern to a screen with the color assigned to each of the plurality of color-based pattern portions;

designate a color of the thread color data from each of the plurality of color-based pattern portions included in the displayed embroidery pattern; and allocate the designated color with priority over the plurality of predetermined colors for each of the plurality of color-based pattern portions.

7. The non-transitory computer readable recording medium according claim 6, wherein displaying the embroidery pattern comprises displaying a plurality of embroidery pattern to the screen, the plurality of embroidery patterns having different combinations of colors assigned to the plurality of color-based pattern portions, and wherein designating the color of the thread color data comprises designating the color of the thread color from each of the plurality of color-based pattern portions in the plurality of embroidery patterns displayed in the screen.

8. The non-transitory computer readable recording medium according claim 7, wherein displaying the embroidery pattern comprises displaying some of the plurality of embroidery pattern to the screen in an enlarging manner, and wherein designating the color of the thread color data comprises designating the color of the thread color from each of the plurality of color-based pattern portions in the plurality of embroidery patterns displayed in the screen in the enlarging manner.

9. The non-transitory computer readable recording medium according to claim 6, further cause the data generator to:

display the embroidery pattern to the screen with the color assigned to each of the plurality of color-based pattern portions.

10. The non-transitory computer readable recording medium according to claim 9, further cause the data generator to:

repeat, after the embroidery pattern has been displayed in the screen, the allocating the designated color with priority over the plurality of predetermined colors based on an input; and display the embroidery pattern comprises displaying, when a new embroidery pattern including a new combination of colors assigned to the plurality of color-based pattern portion is created by the repeating, the created embroidery pattern.

11. The non-transitory computer readable recording medium according to claim 6, further cause the data generator to:

repeat, after the embroidery pattern has displayed in the screen, the assigning the color extracted randomly from the plurality of predetermined colors based on a input to the data generator; and display the embroidery pattern comprises displaying, when a new embroidery pattern including a new combination of colors assigned to the plurality of color-based pattern portion is created by the repeating, the created embroidery pattern.

12. A sewing machine comprising:

a data generator including:

a memory configured to store a plurality of predetermined colors; and a processor configured to control the data generator to:

assign a color, which is extracted randomly from the plurality of predetermined colors, as a thread color data of each of a plurality of color-based pattern portions, the thread color data identifying a color of the color-based pattern portion, and the plurality of color-based pattern portions being included in a embroidery pattern;

display the embroidery pattern to a screen with the color assigned to each of the plurality of color-based pattern portions;

designate a color of the thread color data from each of the plurality of color-based pattern portions included in the displayed embroidery pattern; and allocate the designated color with priority over the plurality of predetermined colors for each of the plurality of color-based pattern portions.

* * * * *